United States Patent [19]

Hanyu et al.

[11] Patent Number: 4,498,405

[45] Date of Patent: Feb. 12, 1985

[54] DUAL-FUNCTION SEWING MACHINE

[75] Inventors: Susumu Hanyu; Yoshikazu Ebata, both of Tokyo, Japan

[73] Assignee: Janome Sewing Machine Co., Ltd., Tokyo, Japan

[21] Appl. No.: 464,741

[22] Filed: Feb. 7, 1983

[30] Foreign Application Priority Data

Feb. 12, 1982 [JP] Japan ..... 57-19541

[51] Int. Cl.[3] ..... D05B 1/14

[52] U.S. Cl. ..... 112/168; 112/163; 112/261; 112/302

[58] Field of Search ..... 112/168, 155, 261, 259, 112/260, 302, 163

[56] References Cited

U.S. PATENT DOCUMENTS 1,822,765 9/1931 Dickey ..... 112/302
4,267,786 5/1981 Hanyu et al. ..... 112/168
4,314,517 2/1982 Kasahara et al. ..... 112/260

FOREIGN PATENT DOCUMENTS 2901139 12/1979 Fed. Rep. of Germany ..... 112/168
1029376 6/1953 France ..... 112/302

*Primary Examiner*—Werner H. Schroeder
*Assistant Examiner*—A. Falik
*Attorney, Agent, or Firm*—Michael J. Striker

[57] ABSTRACT

In a double-function sewing machine including a lock stitch mechanism and an overlock switch mechanism, a stitching portion of an overlock stitch mechanism thereof is positioned at the right side of the machine frame as seen from a machine operator and at a front side with respect to a lock stitching free arm of the lock stitch mechanism. A space is provided between the rear end of the needle plate for the overlock stitch mechanism and the front face of the free arm, through which a fabric to be stitched passes.

7 Claims, 39 Drawing Figures

Prior art

DUAL-FUNCTION SEWING MACHINE

BACKGROUND OF THE INVENTION

The present invention relates to a double-function sewing machine in which two different stitch forming mechanisms are incorporated. More particularly the present invention relates to a double-function sewing machine where a stitching portion of an overlock stitch mechanism is provided at a left side of the machine frame, seen from an operator and at the front side of the frame with respect to a lock stitching free arm, and in which a space is defined between the rear end of a needle plate and the front face of the free arm, through which space a fabric to be sewn passes.

There have been conventional proposals for positions of a stitching portion of the overlock stitching mechanism with respect to a stitching portion of the lock stitching mechanism in the double-function sewing machine. For example, in one proposal these stitching portions have been arranged at the front and back sides, and for their use the sewing machine has been rotated. In another proposal, the stitching portion of the lock stitching mechanism has been removed for use of the overlock stitching mechanism for avoiding hinderance by the lock stitching portion. In conventional modes of positioning of these stitching portions, the sewn fabric could not be observed and it has been difficult to perform the stitching.

SUMMARY OF THE INVENTION

A first object of the present invention is to provide a double-function sewing machine where a stitching portion of an overlock stitching mechanism is provided at the left side of the machine frame, as seen from an operator and at the front side of a lock stitching free arm, and in which a space is defined between the rear end of a needle plate and the front face of the free arm, through which space a fabric to be sewn passes. The overlock stitched fabric passes through the space and between a lower part of the free arm and the base of the machine in the rearward direction in order to prevent hinderance by the stitching portion of the lock stitching mechanism.

Second object of the present invention is to provide a pocket in front of the base of the sewing machine located near the lock and overlock stitching portions for convenience of using, exchanging or receiving parts or accessories for these mechanisms. When the cover of the pocket is closed, an upper surface of the cover serves as a working face for the overlock stitching together with an overlock stitching needle plate so as to provide for stable moving of the sewn cloth. Further when a flat bed of the lock stitching mechanism is needed, the upper surface of the cover is utilized together with the upper surface of the free arm for stably mounting an auxiliary bed which makes a wider working field for the flat bed.

Another object of the present invention is to dispose the thread stands of both mechanisms, facing in the same direction at the rear side of the machine stand, in which a guide plate of a lock stitching thread is housed, and a thread path bar guiding an overlock stitching thread may be, at said housing, moved and housed without changing obliquity of said thread path bar, whereby the outer housing of the sewing machine may be made compact when the sewing machine is housed or transported, and a condition of drawing the thread is satisfactory when using the sewing machine, and the thread is prevented from entangling due to the housing of the sewing machine, which has often occurred in the prior art.

A further object of the present invention is to protect the overlock stitching mechanism with a safety cover and an auxiliary safety cover made of a transparent material and attached to the safety cover. A space is defined between a lower end of the auxiliary safety cover and the needle plate surface of the overlock stitching mechanism, so that the end point of the fabric presser extends a little outside of the auxiliary safety cover, and it is possible to leave the thread passed in the overlock stitching mechanism during operation of the lock stitching mechanism, and vice versa. The sewing operator is protected from the stitching portion of the overlock mechanism, and during the overlock stitching operation the cloth being sewn and the cloth already sewn can be observed.

Still another object of the invention is to protect a dust exhaust plate with a front cover, and open and close the dust exhaust plate as desired for providing convenience of preparing and repairing the overlock stitching mechanism.

A still further object of the present invention is to use a common drive source and flywheel with respect to both mechanisms to make the whole body of the sewing machine compact.

Yet another object of the present invention is to manually switch the two stitch forming mechanisms while the sewing machine is stopped, to thereby avoid the danger that occurs in the prior art, that a main shaft of a non-selected mechanism is rotated less than one rotation before a mechanical switch is finished, to avoid shock to which the mechanism is subjected or to prevent the upper thread of the non-selected mechanism from slipping out from the thread guide.

A further object of the present invention is to exactly make a connection between the selected mechanism and the drive source, and to exactly break the connection between the non-selected mechanism and the drive source and engage it with a switching phase for keeping it safe during operation.

Yet another object of the present invention is to not only drive the selected mechanism by the drive source but also carry out rotational operation thereof in forward and backward directions by manual operation of the flywheel, so that the flywheel may be manually adjusting during the stitch formation.

A still further object of the present invention is to stop the selected mechanism together with the flywheel during coiling of the thread on a thread supply.

Yet, another object of the present invention is to dispose a main shaft of the overlock stitching mechanism at a level higher than that of conventional double-function sewing machine of this type, so that corresponding mechanisms of the overlock stitching mechanism such as the feed dog, the feed bed and the looper mechanism are located lower than the overlock stitching needle plate, and it is possible to arrange the overlock needle plate surface lower than the lock stitch needle plate, so that the aforementioned space may be made minimal for observing the sewn fabric, in addition to the observation of the fabric passing, and the sewing machine may be made as a whole more compact.

A further object of the present invention is to make an end point of a looper driven by the looper mechanism draw different close loci in moving forward and returning travels, to thereby avoid interruption between the looper end point and the needle when the looper goes toward the leftmost point under the needle plate, which has been unavoidable in the prior art.

The invention will be explained in reference to the attached drawings.

BRIEF DESCRIPTION OF THE DRAWINGS

FIGS. 2 to 4 are perspective views of the above, in which FIG. 2 shows a condition for operating a lock stitching free arm, FIG. 3 shows a condition for operating a lock stitching flat bed, and FIG. 4 shows a condition for operating an overlock stitch mechanism;

FIGS. 36 and 37 are views showing relative position between the end point of the looper and the needle as seen from an arrow L of FIG. 27, in which FIG. 36 shows a condition where the end point of the looper passes a point Q of FIG. 35, and FIG. 37 shows a condition where the end point of the looper passes a point R of FIG. 35.

DETAILED DESCRIPTION OF THE PREFERRED EMBODIMENTS

The present invention will be explained with reference to the attached drawings. In FIGS. 1 to 4, the numeral 1 is a double-function sewing machine, 2 is a stitching portion of a lock stitch forming mechanism (called "lock stitch mechanism"), and 3 is a stitching portion of an overlock stitch forming mechanisms (called "overlock stitch mechanism"). These mechanisms are, as later mentioned, alternatively selected and driven by one drive motor (not shown) via a transmission mechanism and switch mechanisms. The non-selected mechanism is held and can not be rotated by any external force.

The numeral 4 is a take-up lever, 5 is an upper thread adjuster, 6 is a backstitch lever, and 7 is a selecting dial. A selected stitching pattern is shown with an indicating line 9 of an indicating window. 10 is a feed dial, 11 is a thread coil shaft of a thread coil mechanism, and 12 (FIG. 5) is a presser lever for the lock stitching.

Figure 5:
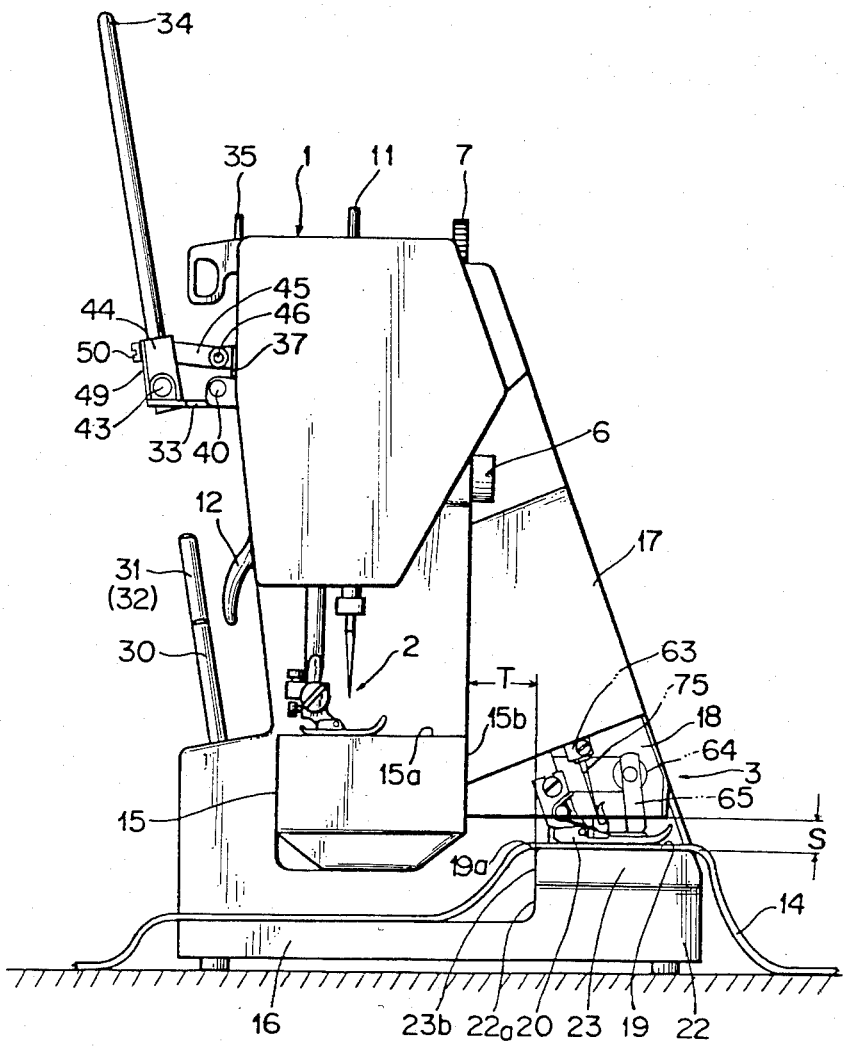
FIG. 5 is a view seen from an arrow A of FIG. 1.
Figure 7:
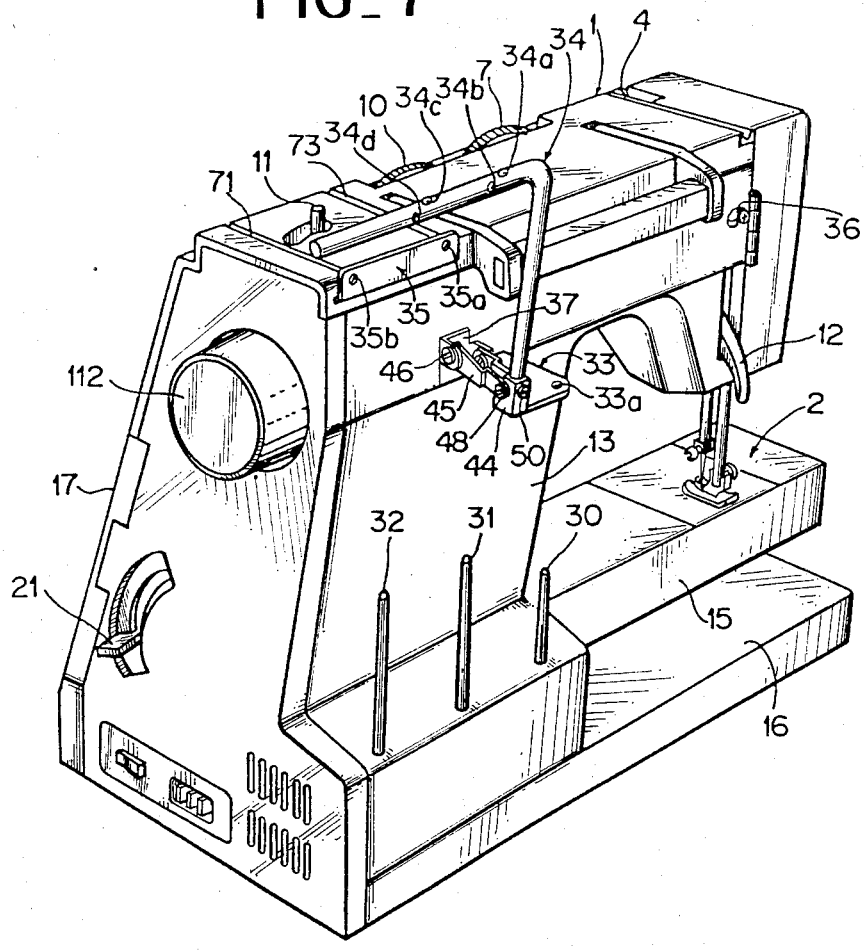
FIG. 7 is a perspective view of the double-function sewing machine, showing a reverse side of FIG. 2.

The stitching portion 3 of the overlock stitching mechanism is provided at the right side of a machine frame 13 as seen from the machine operator and at a front side thereof with respect to a base 16 of a lock stitch free arm 15. A space T is, as shown in FIG. 5, defined between a rear end 19*a* of a needle plate 19 and a front face 15*b* of the free arm 15, through which a fabric 14 to be sewn passes. The overlock stitched fabric 14 is passed through the space T and between a lower part of the free arm 15 and an upper face of the base 16. Therefore the fabric 14 can be fed backwards without touching the stitching portion 2 of the lock stitch mechanism. The space in the vicinity of the overlock stitching mechanism 3 is protected with a safety cover 17 and an auxiliary safety cover 18 composed of a transparent material and secured to the safety cover, so that the stitching operation can be observed through the transparent auxiliary safety cover 18. Further, a space S is defined between a lower end of the auxiliary safety cover 18 and the surface of the needle plate 19 of the overlock stitching mechanism. Since an end point of a fabric presser extends a little outside of the auxiliary safety cover 18, the sewn fabric 14 can be fed without hinderance or obstacle, and the overlock stitching can be carried out as the auxiliary safety cover 18 is attached to the safety cover 17. A presser lever 21 of the overlock stitching is as shown in FIG. 7 is provided outside of the machine frame 13 in the region of the flywheel.

Figure 6:
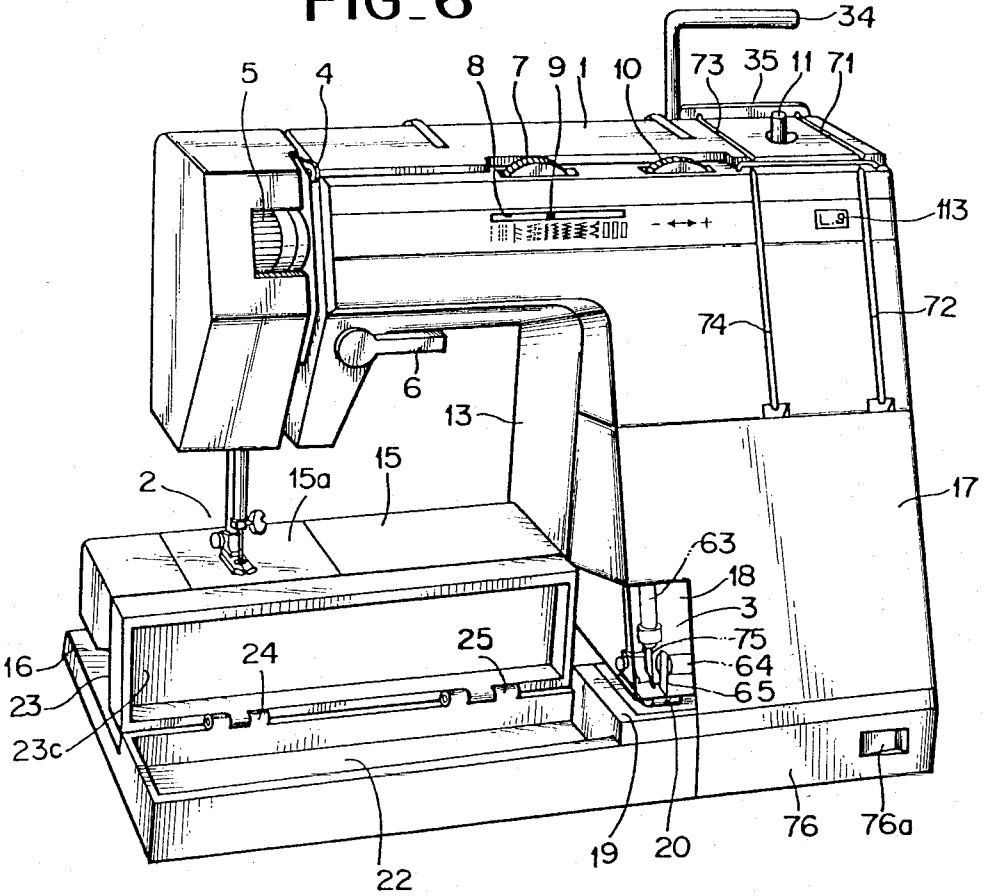
FIG. 6 is a perspective view of the double-function sewing machine, showing a pocket opening and its cover.

In front of the base 16 of the sewing machine, a pocket 22 is provided having a cover 23 which is openable about hinges 24 and 25 (FIG. 6).

When the cover 23 is closed, its upper surface 23*a* (FIG. 1) is at the same level as the surface of the needle plate 19. Both of these surfaces serve as the overlock stitching field so as to provide for stable moving of the sewn fabric 14 (FIG. 5). Further, as shown in FIG. 5, when the cover 23 is closed, its side 23*b* and the side 22*a* of the pocket 22 almost coincide with the plane of the rear side 19*a* of the overlock stitching needle plate 19. Thus the space T is defined between these sides 19*a*, 22*a*, 23*b* and the front side 15*b* of the free arm 15 for feeding backward the sewn fabric 14. The space T should be minimal in size so as to permit the cloth to easily pass therethrough. Under the working condition of the lock stitching free arm, and in the home sewing machine this size is about 7 to 8 mm corresponding to the maximum lifting position of the presser lever 12.

With respect of the overlock stitching, the aforementioned size is sufficient only when the sewn fabric is fed backwards. But for satisfactory observation of the sewn fabric 14, the size should be more than 7 to 8 mm, if the surface of the needle plate 19 were almost the same level or higher than the lock stitching needle plate surface 15*a*, althrough FIG. 5 illustrates the embodiment in which the surface of the plate 19 is lower than the surface 15*a* where the aforementioned size is enough.

The present invention therefore includes not only an embodiment where the surface of the needle plate 19 is lower than the needle plate surface 15*a*, but also includes an embodiment in which the needle plate 19 is disposed at the level higher than that of the needle plate surface 15*a*, and the sewn fabric is passed under the free arm 15 or reversely over the surface of the needle plate 19 almost at the same level as the upper surface of the base 16.

Figure 3:
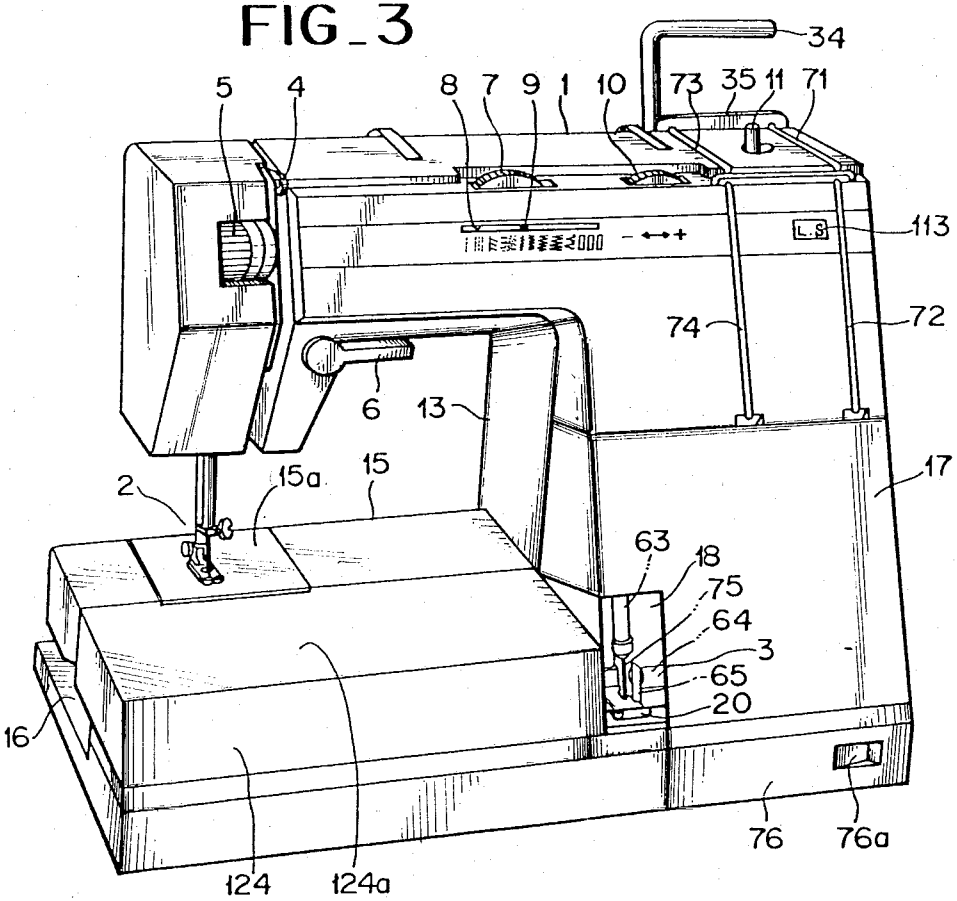

When the flat bed is under work, an auxiliary bed 124 may be mounted on the upper surface 23*a* of the cover 23 as shown in FIG. 3 so that a wide working field may be provided with the upper surface 124*a* of the auxiliary bed 124 and the upper surface 15*a* of the free arm 15.

As seen in FIG. 3, the pocket 22 is provided near the stitching portion 2 of the lock stitch mechanism and the stitching portion 3 of the overlock stitch mechanism. Since the cover 23 is angularly engaged without shielding the stitching portion 2 and 3, the pocket 22 is convenient for adjusting the stitching portions or exchanging the presser, etc. An inner surface 23*c* of the cover 23 may be used as space indicating guide lines for adjustment of the cover or stitching table.

Figure 1:
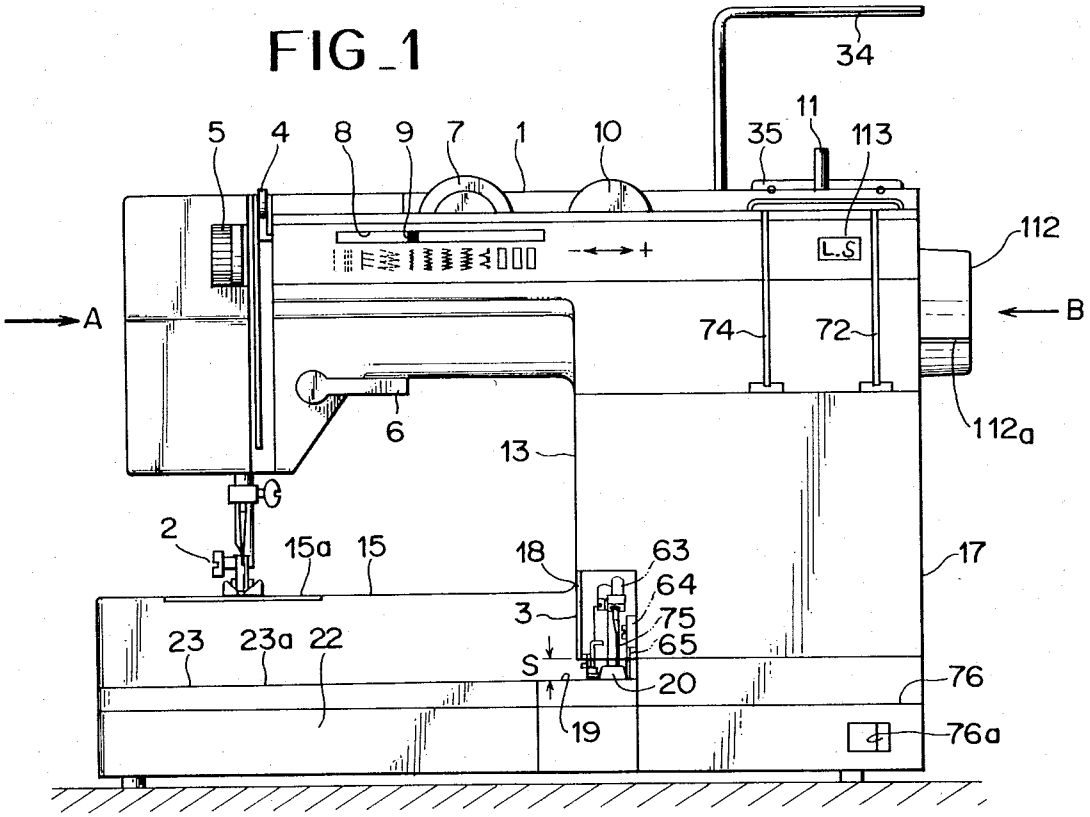
FIG. 1 is a front view of a double-function sewing machine.

A next reference will be made to the thread path or guide mechanism. The double-function sewing machine requires a plurality of threads for the overlock stitching and the lock stitching. When the stitching portions 2 and 3 are disposed in front of the sewing machine as the present embodiment as shown in FIG. 1, a plurality of the thread guides are required to be in front of the sewing machine.

The thread of the overlock stitching is much exhausted in comparison with the lock stitching thread, and it is used with weak tension force and therefore the thread is drawn from a thread source. It is preferable to guide the thread just above the thread source in order to keep the thread drawing condition constant, and avoid unnecessary bending of the thread path. But if a thread stand and a thread guide bar are installed apart from the main body of the sewing machine, the outer body would be bulky and be an obstacle for housing and transporting the sewing machine. For such reasons, the thread guide bar is positioned near the main body of the conventional sewing machine, and necessarily near the thread source.

In the present invention, as shown in FIGS. 5 and 7, all thread stands 30, 31 and 32 are disposed in line at the rear side of the sewing machine. A thread guide plate 33 which guides the thread drawn from the thread source (not shown) can be folded for housing. A thread guide plate which guides the thread from a thread source (not shown) mounted on the thread stands 31 and 32, may be moved and housed when the thread guide plate 33 is folded and housed.

The details thereof will be explained with reference to FIGS. 5, 7 to 12.

The thread stands 31, 32 of the overlock stitching and the thread stand 30 of the lock stitching are arranged in determined obliquity with respect to the machine body 1, as shown in FIG. 5. The thread guide bar 34 is disposed above the thread stands 31, 32, as shown in FIG. 7, and the thread guide plate 33 is disposed above the thread stand 30. The numeral 35 is a thread guide plate of the overlock stitching, and the thread drawn from the thread source (not shown) passes through the thread guide bar 34, and the thread holes 34*a*, 34*b* and through the hole 35*a* of the thread guide plate 35, while the thread from the thread source (not shown) on the thread stand 32 passes through the holes 34*c* and 34*d* of the bar 34 and the hole 35*b* of the plate 35, and these threads are led to the stitching portion 3 of the overlock stitch mechanism. The thread from the thread source (not shown) on the lock stitching thread stand passes through a thread hole 33*a* of the thread guide plate 33 and the thread guide 36 secured to the machine body and goes towards the stitching portion of the lock stitching mechanism.

Figure 8:
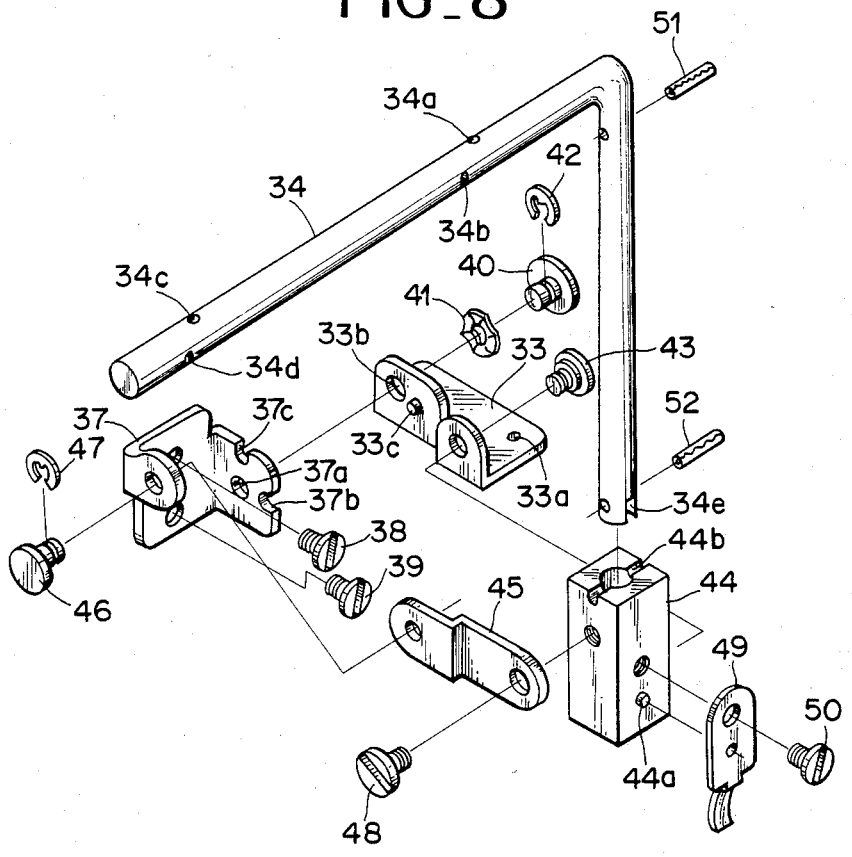
FIG. 8 is an exploded perspective view of a main part of a thread guide mechanism.

As shown in FIG. 8, a thread guide bed 37 is fixed to the machine bed, and a hole 37*a* is mounted with the thread guide plate 33 rotatably about a hole 33*b* by means of a pin 40, a spring washer 41, and E-ring 42. When a projection 33*c* of the thread guide plate 33 engages either of a groove 37*b* or 37*c* of the thread guide bed 37, the thread guide plate 33 is angularly positioned with respect to the bed 37.

Figure 9:
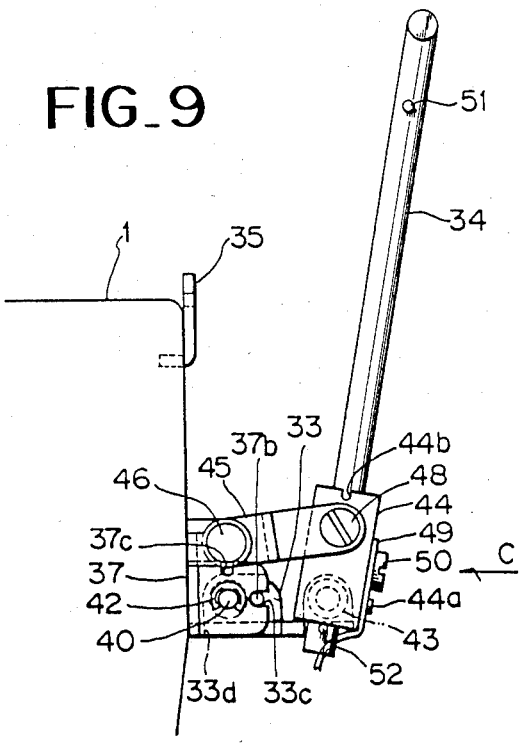
FIG. 9 is a view of the thread guide mechanism, seen from an arrow B of FIG. 1 under use condition.

Referring to FIG. 9, when the projection 33*c* is rotated in the clockwise direction past the groove 37*b* of the thread guide bed 37, a corner 33*d* of the plate 33 contacts the machine body and is restrained from further rotation. The thread guide plate 33 is rotatably connected with a receiving element 44 of the thread guide bar by means of a step screw 43. The bed 37 is rotatably connected with one end of a support arm 45 by a pin 46 and E-ring 47, while the other end of the support arm 45 is rotatably mounted on the receiving element 44 by a step screw 48. The thread guide bar receiving element 44 is slidably mounted with the thread guide bar 34. A spring plate 49 is engaged with a projection 44*a* of the receiving element 44 and is secured with a screw 50. Thread guide bar 34 is implanted with pins 51 and 52, and at use the pin 52 contacts the receiving element 44 at its lower portion as shown in FIG. 9, and a plate 49 engages a groove 34*e* of the thread guide bar 34 and is held at a determined position with respect to the receiving element 44. In the thread guide mechanism, a pin 40, pin 46, step screw 48 and step screw 43 are turning pairs, and this mechanism comprises the bed 37, the support arn 45, the receiving element 44 and the plate 33, and is structured with quadric link where the thread guide bed 37 is a fixed node.

Figure 10:
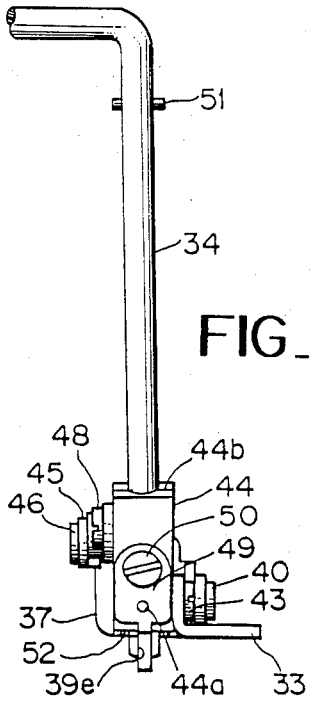
FIG. 10 is a view seen from an arrow C of FIG. 9.
Figure 11:
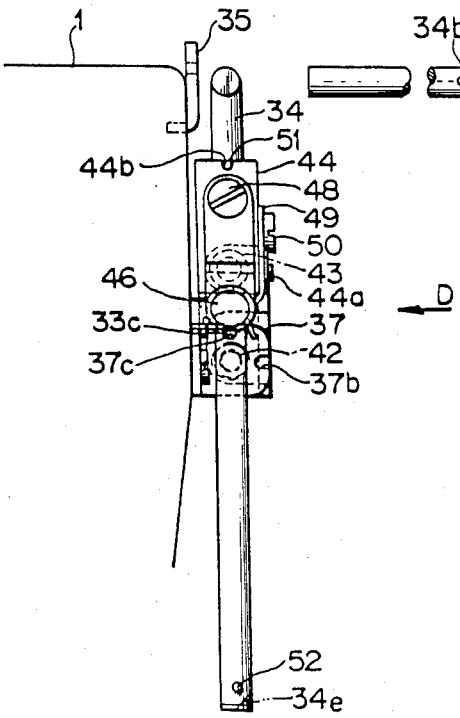
FIG. 11 is a view showing the thread guide mechanism seen from the arrow B of FIG. 1, but in the position different from FIG. 9.
Figure 12:
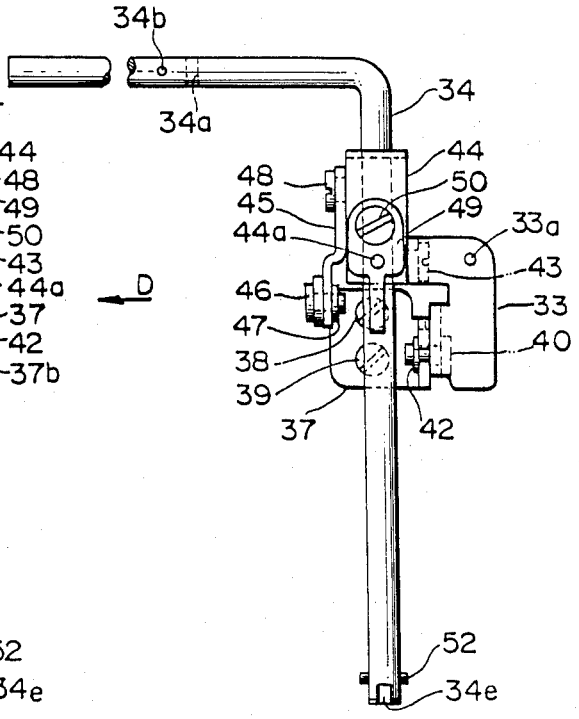
FIG. 12 is a view seen from an arrow D of FIG. 11.

The using condition of the thread guide bar 34 illustrated in FIGS. 9 and 10 is changed to the housed condition when the thread guide plate 33 is rotated about the pin 40 in the counterclockwise direction in FIG. 9. The projection 33*c* comes out from the groove 37*b* of the bed 37 and engages the grooves 37*c*. During this operating process the quadric link in deformed as if it were crushed, and the receiving element 44 is moved without changing angularly the thread guide bar 34 too much with respect to the machine body.

After the thread guide plate 33 is folded, the thread guide bar 34 is urged against a plate spring 49. When the pin 51 is engaged with the groove 44*b* of the receiving element 44, the thread guide bar 34 is held so as not to rotate with respect to the receiving element 44 and becomes housed. If the thread guide bar 34 is urged towards receiving element 44 and the thread guide plate 33 is rotated and folded, then a housing condition may be obtained. The operation from the housing condition to the using condition will be provided by reversing the above operation.

A further reference will be made to the safety cover. In the double-function sewing machine, if the thread is passed in one mechanism while the other mechanism is under use, the switching may be preferably effected rapidly. However, if the stitching portion 3 of the overlock stitching mechanism is arranged in the same direction as the stitching portion 2 of the lock stitching mechanism as seen in the present embodiment, a problem will often occur that the thread of the non-used mechanism is caught buy the other mechanism under operation. Further as shown in FIG. 13, there are necessarily arranged overlock stitching thread adjusters 60, 61, a plurality of thread guides, a movable take-up lever 62, a needle bar 63, a cutter moving arm 64, a cutter 65*m* a looper 66, etc., however, if they were exposed, the overlock stitching mechanism would catch the staff by the lock stitching mechanism not only by use of the former but also by non-use thereof, or if the operator touches the non-used mechanism by her hand.

Figure 13:
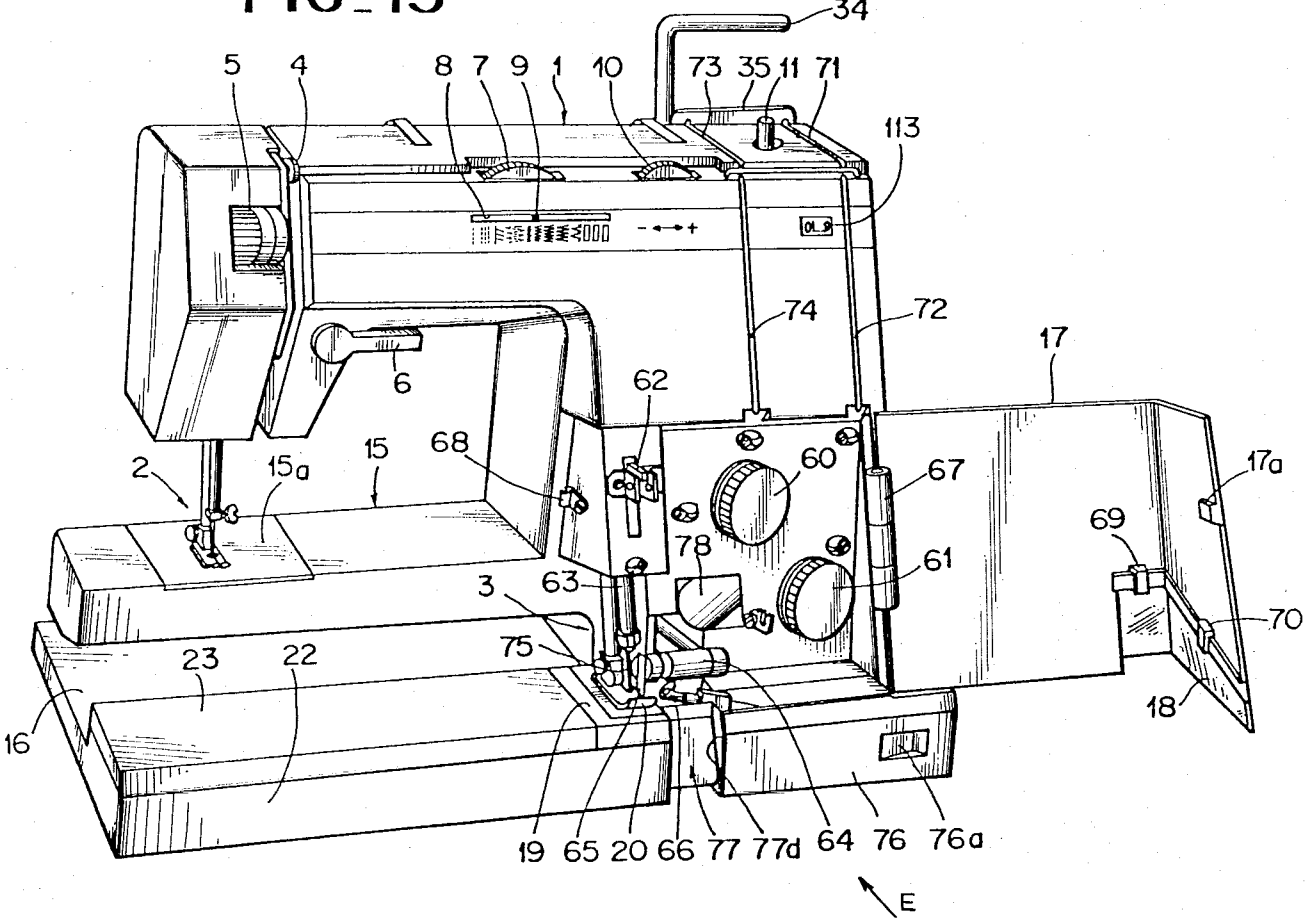
FIG. 13 is a side view of the sewing machine in a condition in which an auxiliary safety cover is opened which is provided to the double-function sewing machine.

Referring to FIG. 13, the safety cover 17 is openably provided on the machine body via hinge 67, and when it is closed a projection 17*a* of the safety cover 17 engages a holding spring 68. The safety cover 17 is provided with projections 69 and 70 of spring property by which an auxiliary safety cover 18 is attached. The auxiliary safety cover 18 is moved together with the safety cover 17 and it shields the space in the vicinity of the stitching portion 3. Under this condition, a space S is defined (FIG. 5) between the auxiliary safety cover 18 and the needle plate 19 for smoothly feeding the sewn fabric 14. A presser foot 20 projects at its curved portion outwardly.

An explanation will be made with reference to FIGS. 7 and 13. The looper thread from the thread source (not shown) on the thread stand 32, passes through thread holes 34*c* and 34*d* of the thread guide bar 34, a thread hole 35*b* of the thread guide plate 35 and a thread groove 71, and goes to the front face of the machine body and advances into the safety cover 17 via a thread groove 72, and reaches the looper 66 via some thread guiding means provided at the thread tension 61 and the machine body.

An overlock thread from the thread source (not shown) on the thread stand 31, passes through thread holes 34*a* and 34*b* of the thread guide bar 34, a thread hole 35*a* of the thread guide plate 35 and a thread groove 73, and goes to the front face of the machine body and advances into the safety cover 17 via a thread groove 74, and reaches the needle 75 via a thread tension 60 and a take-up lever 62 and some thread guiding means provided on the machine body and the overlock needle bar 63. The looper thread and the overlock thread are guided when the safety cover 17 is opened, otherwise it is closed so that the thread that is kept passed in the non-used overlock stitching mechanism is not caught by the lock stitch mechanism when operating, and switching between both mechanisms can be rapidly effected. When the safety cover 17 and the auxiliary safety cover 18 are closed, they shield the thread tensions 60 and 61, the plurality of thread guiding means, the movable take-up lever 62, the needle bar 63, the cutter moving arm 64, the cutter 65, etc. The looper 66 is covered with a front cover 76 and dust exhaust plate 77, and therefore, the overlock stitching mechanism does not catch the cloth sewn by the lock stitching mechanism or is not contacted by the operator, irrespectively of using or non-using of the overlock stitching mechanism.

In use of the overlock stitching mechanism, the auxiliary safety cover 18 made of a transparent substance is positioned to shield the space in the vicinity of the stitching portion 3, and a lamp 78 of the overlock stitching mechanism is inside of the safety cover 17 which does not reflection of the light outside of the auxiliary safety cover 18, and therefore the stitching portion 3 and the space in its vicinity thereof could be clearly observed while using the overlock stitching mechanism.

A two step door type front cover mechanism will be explained in reference to FIGS. 13 to 17. The numeral 77 is a fabric dust exhaust plate. If the stitching portion 3 of the overlock stitching mechanism is arranged in the same direction as the stitching portion 2 of the lock stitching mechanism, the swtiching between the two mechanisms may be rapidly effected, and it is not desirable that the dust exhaust plate 77 be exposed. The two step door type front cover solves this problem.

Figure 2:
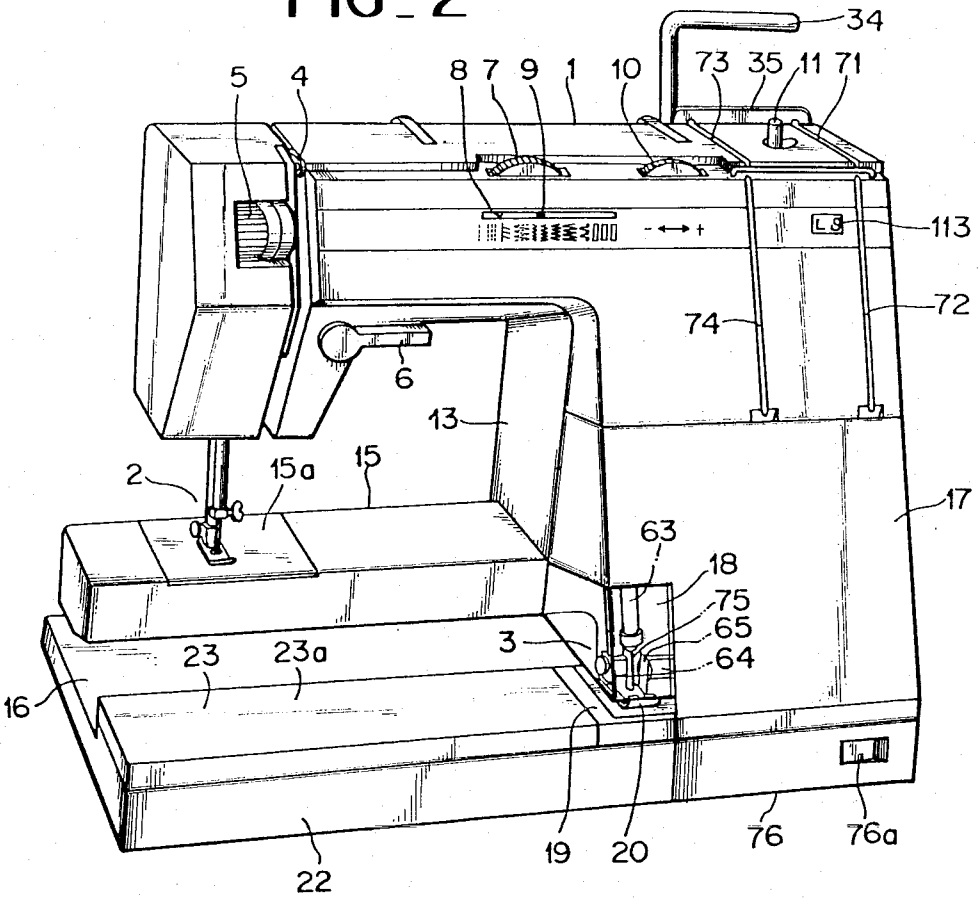
Figure 4:
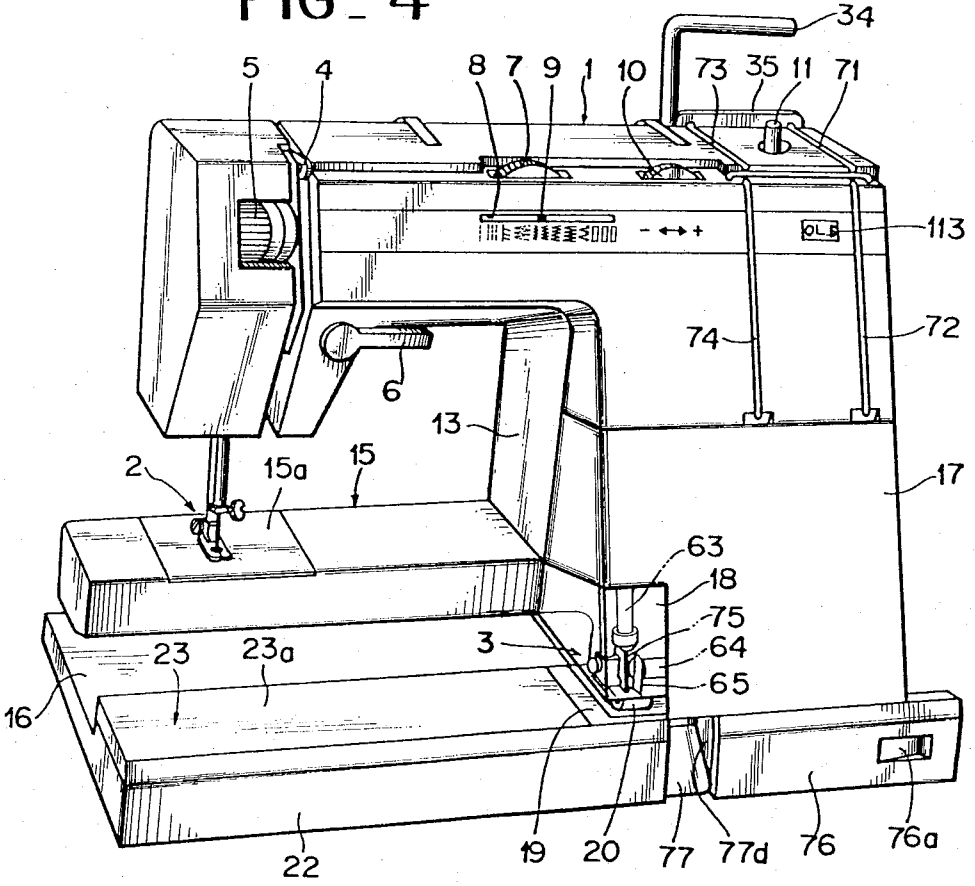

When the overlock stitching mechanism is used, the dust exhaust plate 77 is exposed as shown in FIG. 4 to exhaust dust occuring during the overlock stitching operation. When the lock stitching mechanism is used or the sewing machine is at rest, the exhaust plate 77 is shielded with the front cover 76 as shown in FIG. 2.

The front cover 76 is moved laterally via an operator 76*a* to cover or expose the dust plate 77. By pushing an operator 77*d* when the dust plate 77 is exposed, the plate 77 is moved, and the front cover 76 is opened to provide convenience of preparing and repairing the overlock stitching mechanism.

A further explanation will be made in reference to FIGS. 14 to 17. A cover hinge arm 80 is rotatably supported to the machine frame 84 via a hinge shaft 83 which is thrust-stopped by E-rings 81 and 82. The cover hinge arm 80 is fixed with a cover bed 85 by means of screws 86 and 87 passing through holes 80*a* and 80*b*, and screw holes 85*a* and 85*b* formed in the cover bed 85.

The front cover 76 is defined with bosses 76*b* and 76*c* which are formed with screw holes 76*a* and 76*e* into which step screws 89 and 90 are screwed, running through holes 88*a* and 88*b* of a slide plate 88 and an oblong groove 85*c* of the cover bed 85. The front cover 76 is slidable with the slide plate 88 with respect to the cover bed 85. The slide plate 88 is formed with engaging faces 88*c* and 88*d* with which a spring 92 mounted on a step screw 91 screwed into a screw hole 85*d* of the bed cover 85, engages angularly at a place where the front cover 76 shields the dust exhaust plate 77. This plate 77 is slidably attached to the cover bed 85 by means of step screws 93 and 94 screwed into holes 85*e* and 85*f* of the cover bed 85.

A stopper bed 95 is fixed to the cover bed 85 by means of screws 96 and 97 running through the holes 95*a* and 95*b* and screwed into holes 85*g* and 85*h* of the cover bed 85. A stopper 95 is mounted on its pin 95*c* with a spring 98 and is rotatably mounted with a stopper 99 via a hole 99*a*. The stopper is biased in the counter-clockwise direction in FIG. 17 and is thrust-stopped by an E-ring 100.

Figure 17:
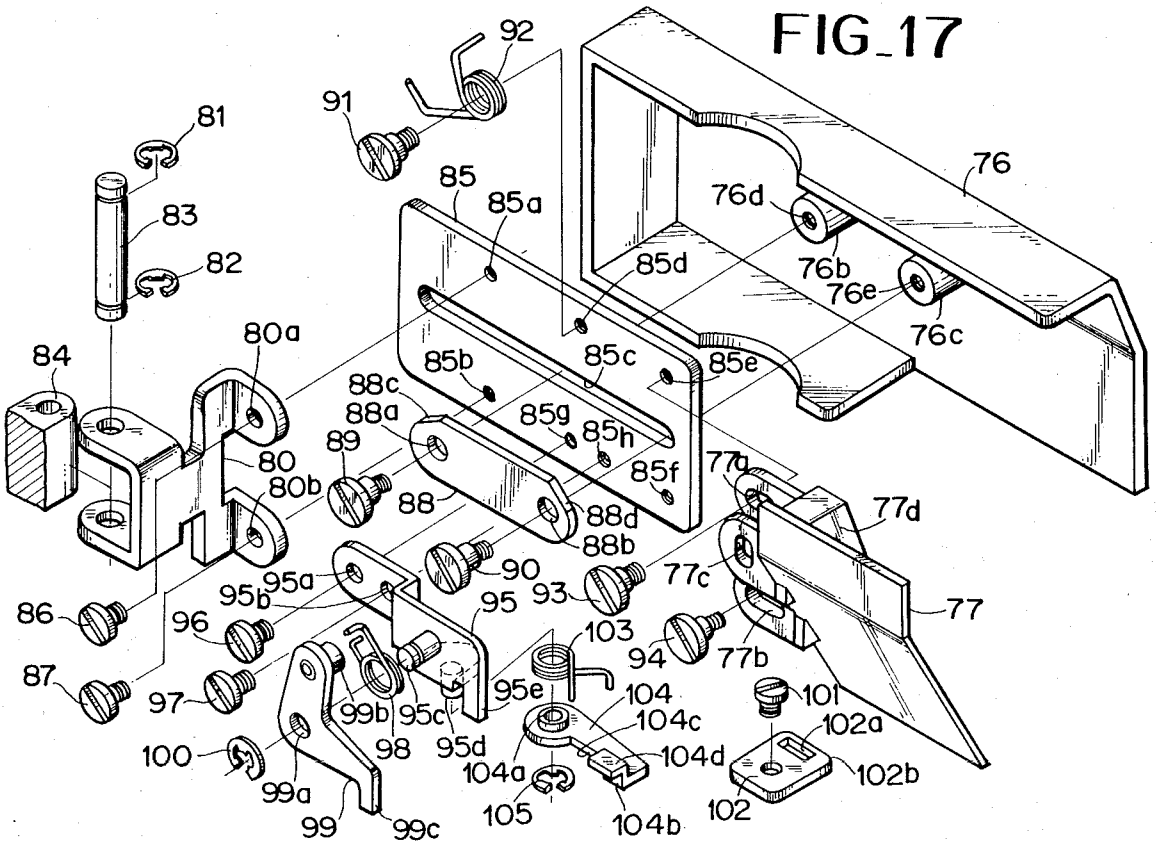
FIG. 17 is an exploded view of a main part of the two step front cover mechanism.

A pin 99*b* of the stopper 99 goes into oblong hole 77*c* of the dust exhaust plate 77, and biases the plate 77 to the left in FIG. 17, while a pawl 99*c* of the stopper 99 engages a hole 102*a* of a securing piece 102 fixed to the machine frame by a screw 101 in order to lock open the cover about the hinge shaft 83.

The stop bed 95 is mounted on its pin 95*d* with a spring 103, and a stopper engaging piece 104 is rotatably mounted via a hole 104*a* thereon, and is thrust-stopped by E-ring 105 and biased in the clockwise direction in FIG. 17. A portion 104*b* contacts a portion 102*b* of the securing piece 102.

Figure 14:
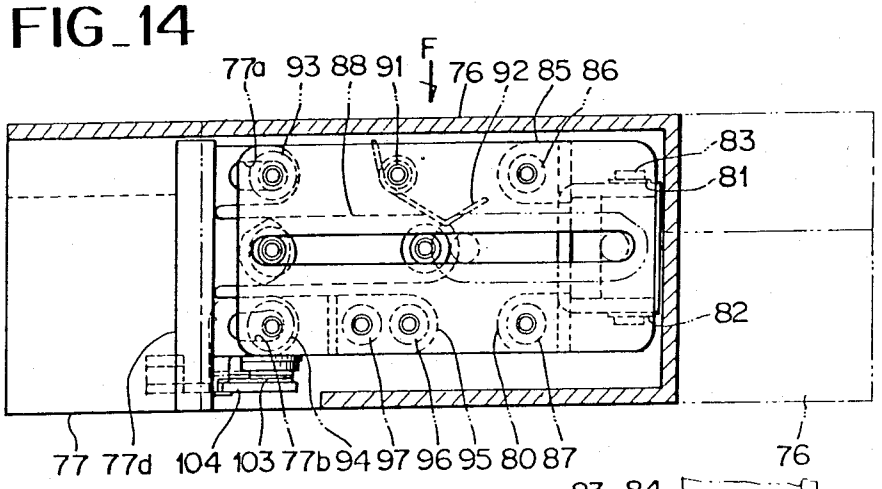
FIG. 14 is a cross sectional view of a two step front cover seen from the arrow E of FIG. 13.
Figure 15:
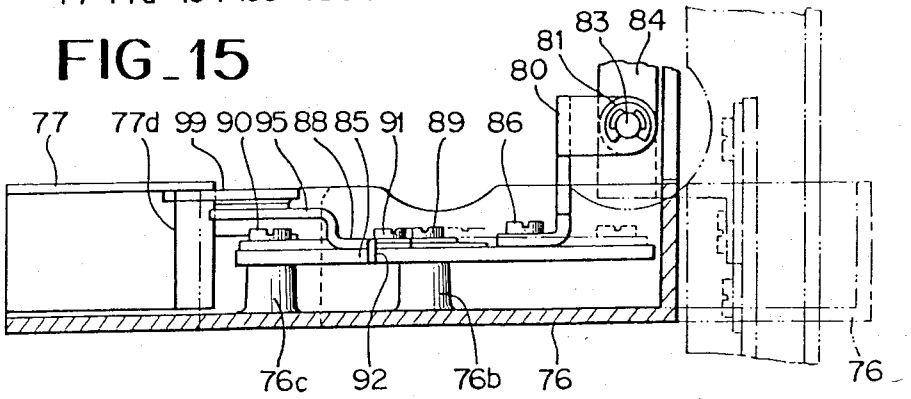
FIG. 15 is a cross sectional view seen from an arrow F of FIG. 14.
Figure 16:
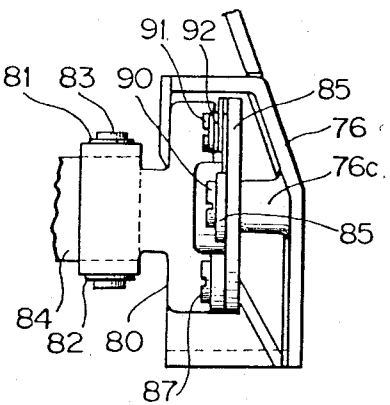
FIG. 16 is a view seen from an arrow G of FIG. 14.

In FIG. 14, when the front cover 76 is moved to the right by an operating member 76*a*, the dust exhaust plate 77 is exposed and removes dust occuring during the overlock stitching. When the operator 77*d* is exposed together with the exhaust plate 77, and when the operator 77*d* is pushed to the right, the dust plate 77 slides along the oblong holes 77*a* and 77*b*. The stopper 99 is rotated about a pin 95*c* of the stopper 95 via the oblong hole 77*c* and the pin 99*b*, and since the pawl 99*c* comes out from the hole 102*a* of the securing piece 102, the cover bed 85 enables release of the hinge shaft 83 to the front side of the machine body, accompanying the front cover 76 and the dust plate 77, for convenience of preparing and repairing the overlock stitching mechanism. In this case, since the face 104*b* of the stopper piece 104 is released from the face 102*b* of the securing piece 102, the stopper piece 104 is rotated by the spring 103 until the face 104*c* contacts the engaging piece 95*e* of the stopper bed 95. The face 104*d* of the stopper piece 104 goes under the pawl 99*c* of the stopper 99 to prevent the stopper 99 from rotation by the spring 98, and therefore, the exhaust plate 77 is held as sliding.

When the front cover 76 is closed together with the dust plate 77 about the hinge shaft 83, the face 104*b* of the stopper piece 104 is pressed to the face 102*b* of the securing piece 102 to release the pawl 99*c* of the stopper 99 by the face 104*d* of the stopper piece 104 so that the stopper 99 is biased by the spring 98, and the pawl 99 engages the hole 102*a* of the securing piece 102, to thereby keep the closed condition and return the plate 77 via the pin 99*b* and the oblong groove 77*c* to the condition before sliding.

When the overlock stitching mechanism is at rest, the dust plate 77 exposed from the front cover 76 is moved to the left in FIG. 13 through the operating member 76*a* and is covered with the front cover 76.

A switching mechanism will be now referred to. In the double-function sewing machine, while one mechanism is worked, the other mechanism is stopped, and this condition is especially important to the case that the both stitching portions 2 and 3 are disposed at the front part of the sewing machine as shown in FIG. 1.

It is desirable to use the common driving source for structuring a compact machine body, and due to such circumstances a switching device is required with regard to the driving source.

Figure 18:
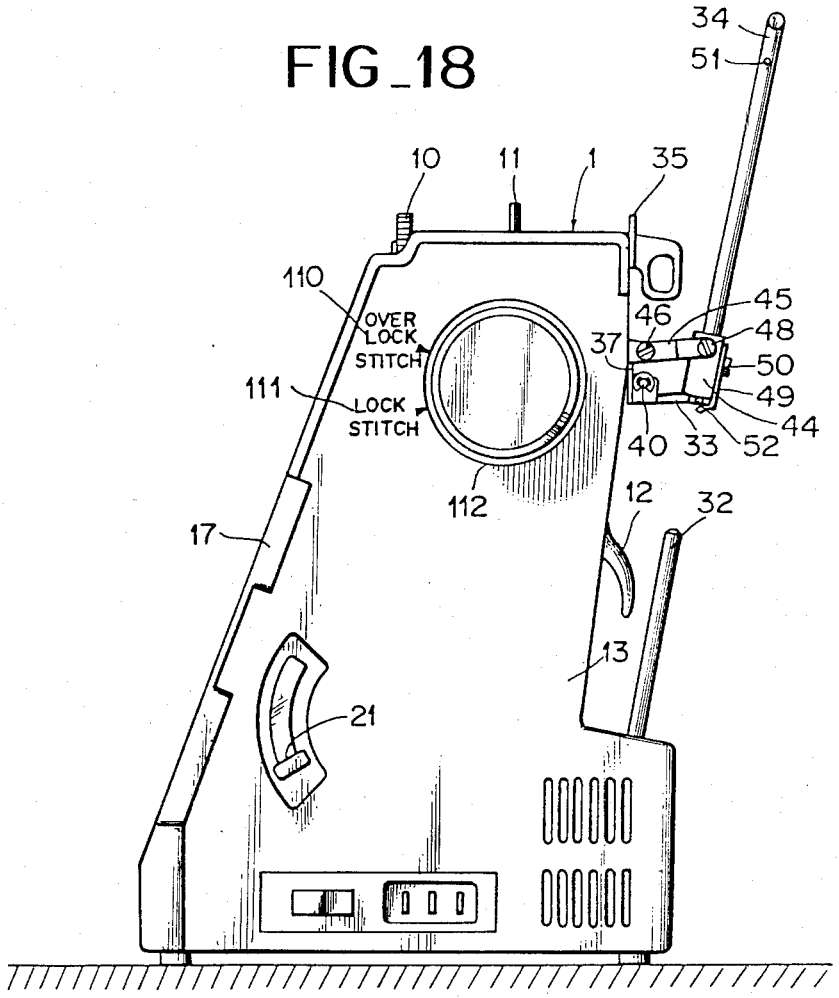
FIG. 18 is a view seen from the arrow B of FIG. 1.

In FIG. 18, a side of the flywheel 112 of the machine body is shown with an overlock mark 110 and a lock stitch mark 111. If an indication line 112*a* (FIG. 21) of the flywheel 112 is met with either of them, the stitching mechanism is alternatively selected and this selection is indicated on an indicating window 113 shown in FIG. 1.

A reference will be made to FIGS. 19 to 22. The numeral 114 is a belt wheel bush, and a declutch seat 114*b* is formed on its outer circumference 114*a*, and the belt wheel bush 114 is fixed to a driving shaft 116 by a screw 115. The bush 114 is secured with a washer 119 having a pin 119*a* by a screw 120 through a washer 117 and a spring element 118.

A clutch lever 121 is formed with a hole 121*a* and a projection 121*b*, and with a guide 121*d* having a guide groove 121*c*, and this clutch lever 121 is pivoted on a pin 119*a* of the washer 119 via a hole 121*a*. The belt wheel bush 114 is mounted on its outer circumference 114*a* with a belt wheel 122 at its inner circumference 122*a*. With respect to the clutch lever 121, the projection 121*b* is biased in opposition to the face 118*a* of the spring element 118 about a pin 119*a* of the washer 119 by means of a twisted coil spring 123 held between the clutch lever 121 and the spring element 118, and the guide portion 121*d* in a space between the upper face of a minor plate 124 positioned on the declutch seat 114*b* and the inner surface 122*a* of the belt wheel 122, guides a roller 188 toward a space narrower than said space.

A washer 125 is fitted on an outer circumference 114*a* of the belt wheel bush 114 at its inner circumference 125*a* and on the upper face of the minor plate 124. A washer 127 contacts the belt wheel 122 to restrict actuation of the belt wheel in the axial direction to the belt wheel bush 114 together with the washer 117.

The belt wheel 122 is formed with a knurl 122*b* and a belt gear 122*c*, and the knurl 122*b* drives a later mentioned thread coiling mechanism, and the belt wheel is connected to a motor (not shown) via a belt 128 (FIG. 23) mounted on the belt gear 122*c*.

The numeral 129 (FIG. 20) is a bearing tube secured to the machine frame, into which a driving shaft 116 is mounted. 130 is an overbelt wheel connected to the overlock stitching mechanism via a belt 131 (FIG. 23) wound on the belt gear 130*d*. The overbelt wheel 130 is defined on its side with a guide groove 130*b*, a fitting groove 130*c* and a screw hole 130*d*.

The overbelt wheel 130 (FIG. 20) is restrained with respect to the position in the axial direction by means of a ring 133 fixed to the drive shaft 116 by a screw 132, and its side face 130*e* partially slides on an end face of a connecting ring 135 of the overlock stitching fixed to the drive shaft 116 by a screw 134. A connecting pawl 136 is defined with a pawl portion 136*a*, an engaging groove 136*b* and a release groove 136*c* for the driving shaft 116. The connecting pawl 136 is guided by the end side of the overlock stitching connection ring 135 and the guide groove 130*b* under a condition where the drive shaft 116 is inserted into the release groove 136*c*, and the pawl portion 136*a* is biased toward the engaging groove 135*a* of the overlock stitch connecting ring 135 by means of a spring 138 which is fixed at its one end to the overbelt wheel 130 by a screw 137. The drive shaft 116 is fitted into the bearing tube 139 which is fixed to the machine frame 84, and is secured with a lock stitching connecting ring 141 by a screw 140. The lock stitching belt wheel 142 is idle on a lock stitching upper shaft 143, and is connected to a lower shaft of the lock stitch mechanism via a belt 144 wound on the belt gear 142*a*. The lock stitching belt wheel 142 is defined on its side with a guide groove 142*b*, a fitting groove 142*c* and a screw hole 142*d*.

The lock stitching belt wheel 142 is restrained with respect to the position in the axial direction by means of a ring 145 fixed to the lock stitch upper shaft 143 by a screw 147, and its side face partially slides on an end of a lock stitch connecting ring 141. A connecting pawl 146 is defined with a pawl portion 146*a*, an engaging groove 146*b* and a release groove 146*c* for the lock stitch upper shaft 143. The connecting pawl 146 is guided by the end side of the lock stitch connecting ring 141 and the guide groove 142*b* under a condition where the upper shaft 143 is inserted into the release groove 146*c*, and the pawl portion 146*a* is biased toward the engaging groove 141*a* of the connecting ring 141 by means of a spring 149 which is fixed at its one end to the belt wheel 142 by a screw 148.

A switching shaft 150 (FIG. 21) is rotatably supported to the machine frame 84, and is secured with a lock stitch switching arm 153 and an overlock stitch switching arm 154 via a thrust-stopper 152 which is fixed to the machine frame 84 by a screw 151. The lock stitch switching arm 153 is formed at its one end with an engaging pawl portion 153*a* and faces at its other end to an actuating piece 157 of a microswitch. The overlock stitch switching arm 154 is formed with an engaging pawl portion 154*a* and a hole 154*b*. Between the hole 154*b* a hole 159*a* of a spring element 159 secured to the machine frame 84 by a screw 158, a switching spring is arranged, shown in FIG. 24, and if the hole 154*b* of the overlock stitch switching arm 154 exceeds downwardly a segment J connecting the shortest distance between the hole 154*b* and the hole 159*a* within a turning range of the overlock stitch switching arm 154 about a switching shaft 150, the overlock stitch switching arm 154 is biased downwardly. The engaging pawl portion 154*a* is engaged with the engaging groove 136*b* of the connecting pawl 136 and the engaging groove 130*c* of the overlock stitch belt wheel 130, and the lock stitch switching arm 153 is releaved from the connecting pawl 146*b* and the engaging groove 142*c* of the lock stitch belt wheel 142. When the hole 154*b* of the overlock stitch switching arm exceeds downwardly the segment J in FIG. 24, the overlock stitch switch arm 154 is biased upwardly and the engaging pawl portion 154*a* is separated from the engaging groove 136*b* of the connecting pawl 136 and the engaging groove 130*c* of the overlock stitching belt wheel 130, and the engaging pawl portion 153*a* of the lock stitch switching arm 153 is engaged with the engaging groove 146*b* of the connecting pawl 146 and engaging groove 142*c* of the lock stitching belt wheel 142. The switching shaft 150 (FIG. 21) is secured at its end with a switching gear 162 by a screw 161, which has a gear 162*a* and an indicator 162*b* for indicating a selected stitching mechanism. The indicator 162*b* comprisese an indication 162*c* of the lock stitch and an indication 162*d* of the overlock stitch, and these indications are distinguished with letters, marks or colors.

Figure 21:
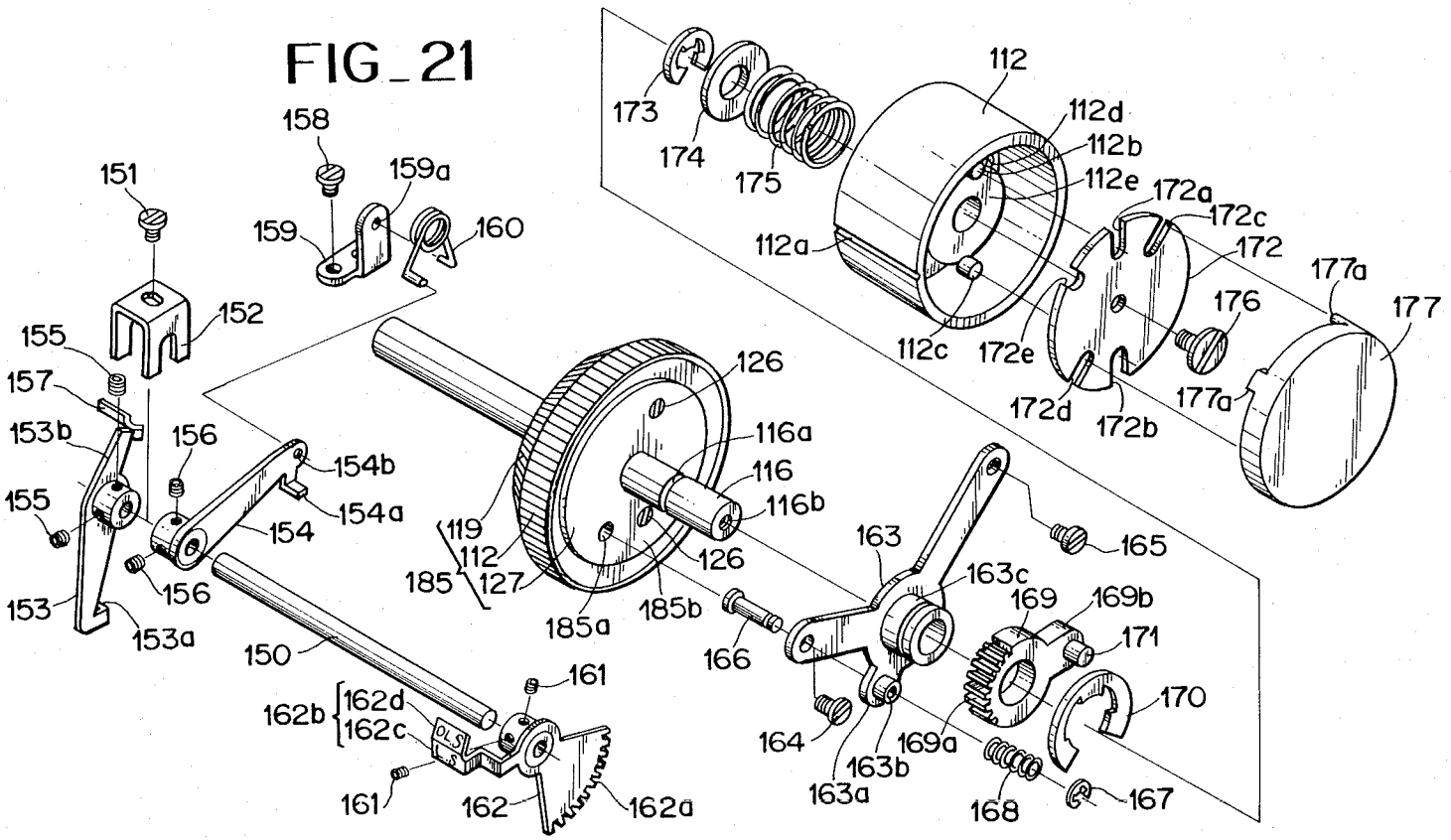
FIG. 21 is an exploded view of a main part of the switching mechanism not seen in FIG. 20.

A gear bed 163 is fixed to the machine frame 84 by screws 164 and 165, and a guide hole portion 63*b* defined in an arm 163*a* is inserted with a stopper pin 166 so that the gear bed 163 is biased to the right in FIG. 21 by a spring 168 through E-ring 167. The gear bed 163 is rotatably mounted with a flywheel gear 169 on an outer diameter of a boss 163*c* and is thrust-stopped with E-ring 170. The gear 169*a* is geared with a gear 162*a* of a switch gear 162, and at the same time a projection 171 projecting from an arm 169*b* is engaged with a flywheel 112 by the operation at a specific phase of the flywheel 112, so that the gear 169 is rotated by the flywheel 112. The gear bed 163 is inserted with a driving shaft 116 within an inner diameter of a boss 163*c*.

The flywheel 112 is formed with an indication line 112*a* on the outer circumference, and is provided with a pair of driving pins 112*b* and 112*c* and a switching hole 112*d* in positions relative to the indication line 112*a*. The numeral 172 is a phase plate which is formed with a pair of driving grooves 172*a* and 172*b* and a pair of driving grooves 172*c* and 172*d* in relative positions, and with a groove 172*e*.

Figure 23:
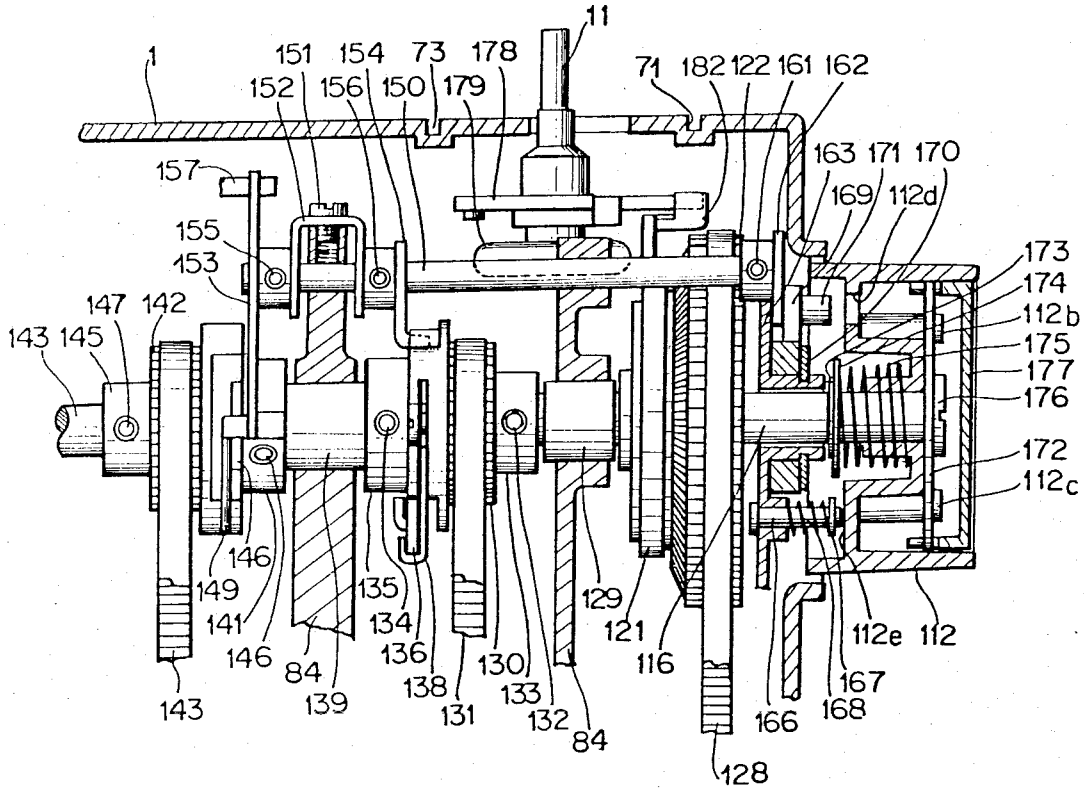
FIG. 23 shows a cross sectional view of the switching mechanism and the thread coiling mechanism, with the selection of the lock stitching.

The flywheel 112 which is rotatably mounted on the drive shaft 116, is biased to the right in FIG. 21 by a spring 175 via E-ring 173 fitted in a groove 116*a* of the drive shaft 116 and a washer 174 mounted on the drive shaft 116. The flywheel 112 is engaged at its end face 112*e* with a phase plate 172 which is fixed to an end 116*b* of the drive shaft 116 by a screw 176 as shown in FIG. 23, and a pair of drive pins 112*b* and 112*c* engage the drive grooves 172*a* and 172*b* when the lock stitching mechanism is selected. The numeral 177 is a cover of the flywheel and pawls 172*a* at three portions engage a groove 172*e*, and drive grooves 172*c* and 172*b*.

Figure 22:
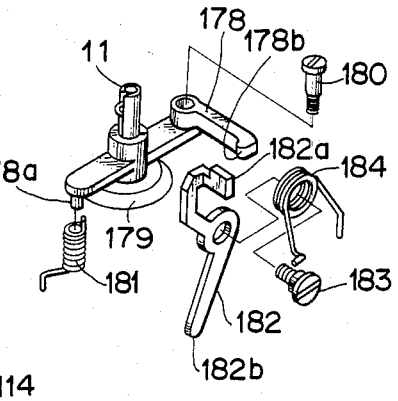
FIG. 22 is an exploded view of a main part of a thread coiling mechanism.
Figure 19:
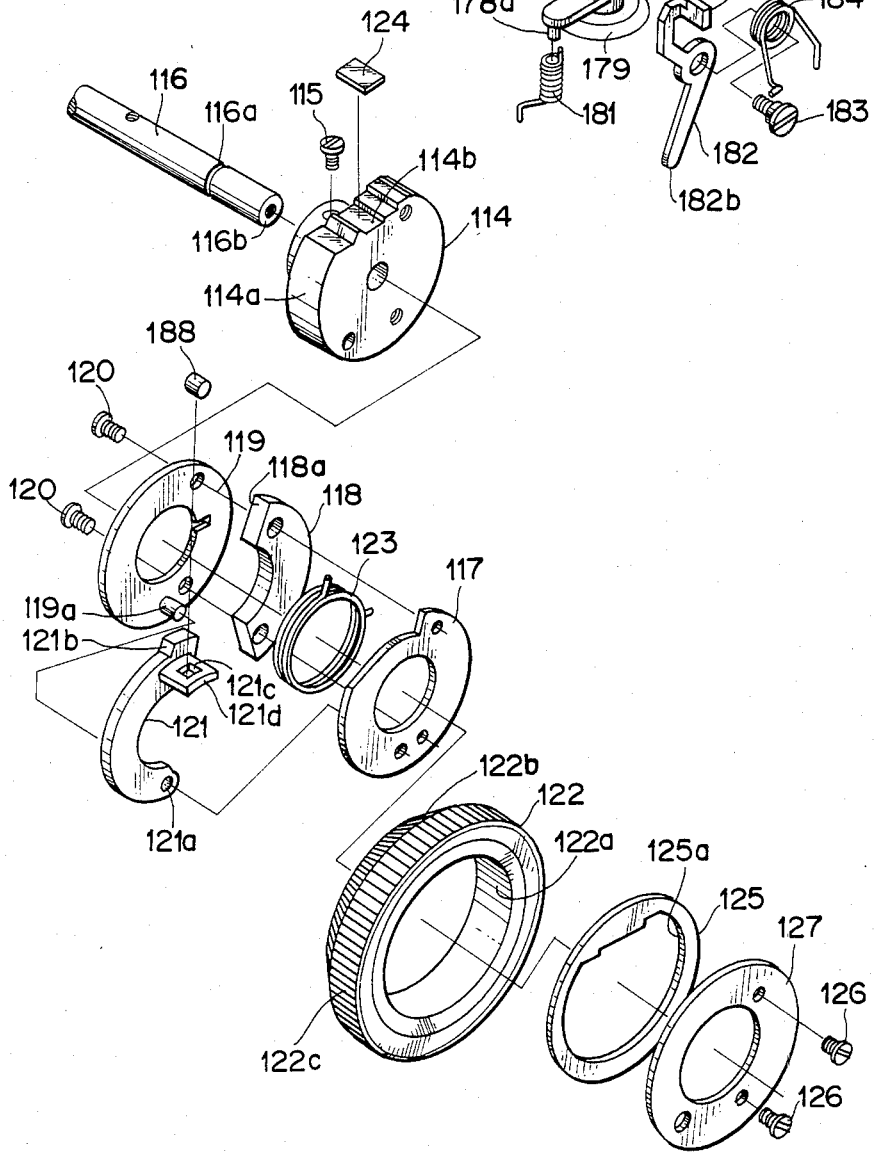
FIG. 19 shows exploded views of a belt wheel and a de-clutch mechanism, respectively.
Figure 20:
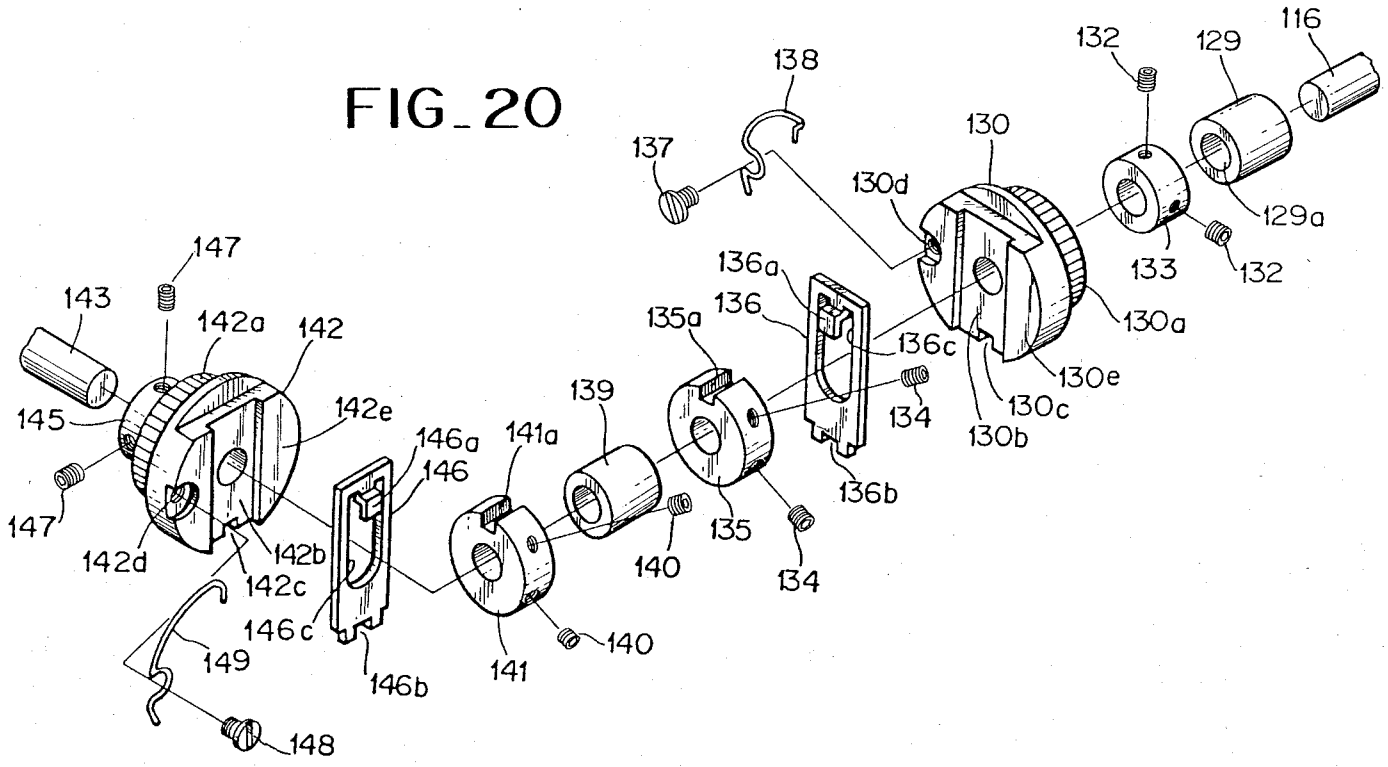
FIG. 20 is an exploded view of a main part of a switching mechanism.

A thread coiling mechanism will be now explained. In FIG. 22, a thread coil arm 178 rotatably holds a coil shaft 11 equipped with a coiling rubber 179, and is pivoted by a stepped screw 180. A spring 181 is positioned between the machine frame 84 and a pin 178*a* of the coiling arm 178. The coiling arm 178 is biased in the clockwise direction around the step screw 180 by the spring 181 and is positioned so as to separate the coiling rubber 179 from the knurl 122*b* of the belt wheel 122 and to bias the coiling arm 178 in the counterclockwise direction about the step screw 180 and to press the coiling rubber 179 to the knurl of the belt wheel 122.

The declutch arm 182 is pivoted on a step screw 183 fixed to the machine frame 84 and is biased in the clockwise direction in FIG. 22 about the step screw 183 by a spring 184 between the declutch arm 182 and the machine frame 84. Under the condition that the thread is not coiled, an engaging portion 182*a* of the declutch arm 182 contacts a projection 178*b* of the coiling arm 178. Under the condition that the thread is coiled, that is the condition where the coiling arm 178 is rotated in the counterclockwise direction in FIG. 22 and the coiling rubber 179 is pressed to the knurl 122*b* of the belt wheel 122, the projection 178*b* is separated from the engaging portion 182*a* and a lower end 182*b* of the declutch arm goes into a moving locus of the projection 121*b* of the clutch lever 121.

With respect to switching from the lock stitching selected condition to the overlock stitching condition, while the sewing machine is stopped, the flywheel 112 is manually rotated so that the indication line 122*a* coincides with the lock stitching mark 111, and the flywheel 112 is pushed in the direction of arrow H in FIG. 23 and rotated in the clockwise direction seen from the side of the flywheel 112 so that the indication line 112*a* coincides with an overlock mark 110. If the hand is released under this condition, the flywheel 112 is pushed out in the direction opposite to the arrow H and the overlock stitching is selected. Then the indication window 113 indicates the indication 162*d* of the overlock stitching and the lamp of the lock stitching (not shown) is turned off and a lamp 78 of the overlock stitching is turned on.

With respect to switching from the overlock stitching selected condition to the lock stitching condition, while the sewing machine is stopped, the flywheel 112 is manually rotated so that the indication line 112*a* coincides with the overlock mark 110, and the flywheel 112 is pushed in the direction of arrow H and rotated in the counterclockwise direction so that the indication line 112*a* coincides with the lock stitching mark 111. If the hand is released under this condition, the flywheel 112 is pushed out in the direction opposite to the arrow H and the lock stitching is selected. Then the indication window 113 indicates the indication 162*c* of the lock stitching, and the lamp of the lock stitching (not shown) is turned on and the lamp of the overlock stitching is turned off.

Figure 24:
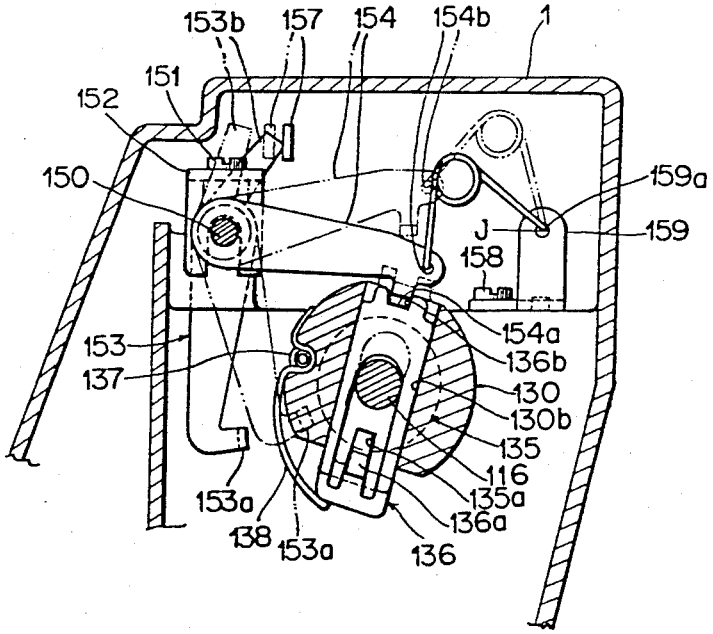
FIG. 24 is a cross sectional view of the stitching mechanism seen from an arrow H of FIG. 23.
Figure 25:
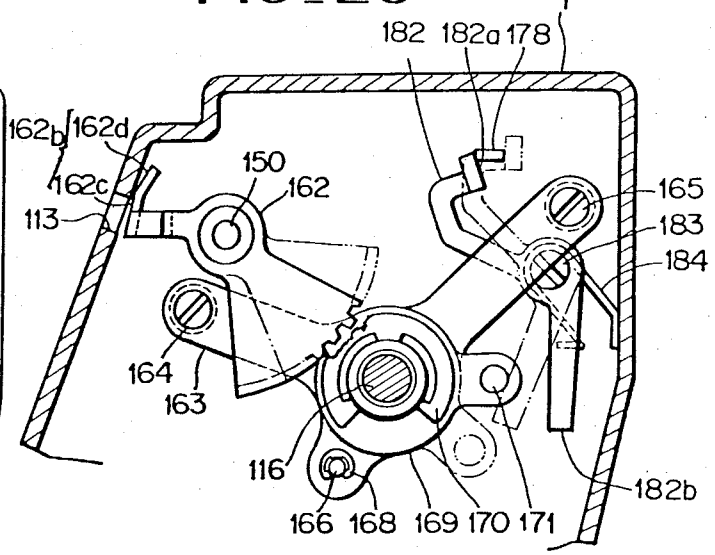
FIG. 25 is a cross sectional view of the stitching mechanism seen from an arrow H of FIG. 23, explaining the actuation of the thread coiling mechanism.
Figure 26:
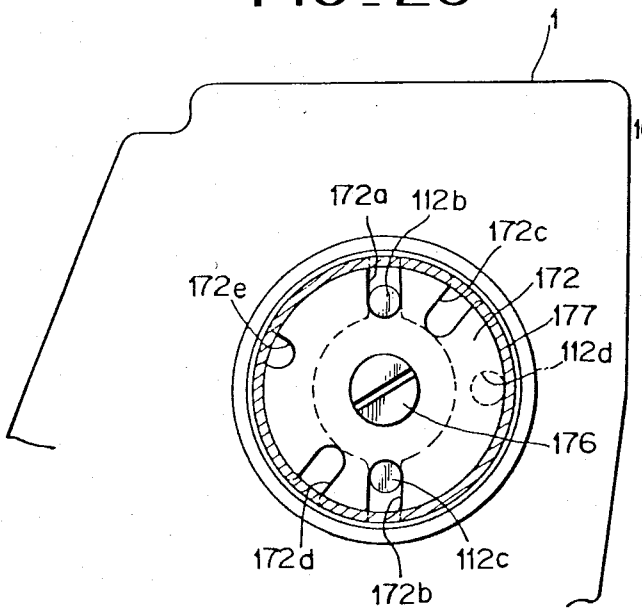
FIG. 26 is a view, partially in section, showing relationship between a phase plate and a driving pin of the flywheel.

The above mentioned embodiment will be explained more in detail. As shown in FIG. 24, the overlock switch arm 154 pushes with its pawl portion 154*a* the connection pawl 136 guided in the guide groove 130*b* of the overlock belt wheel 130 against the spring 138 by the action of the switching spring 160, and pushes out the pawl portion 136*a* from the engaging groove 135*a* of the overlock stitch connection ring 135, and breaks the connection between the drive shaft 116 and the overlock stitch belt wheel 130, and at the same time the engaging pawl portion 154*a* is engaged with the engaging groove 136*b* of the pawl 136 and the engaging groove 130*c* of the overlock stitch belt wheel 130. Therefore, the overlock stitch connection ring 135 does not transmit rotation to the overlock stitching belt wheel 130 even if any external action is applied to the overlock stitch mechanism. Also in this condition, the lock stitch switching arm 153 is separated at its engaging pawl portion 153*a* from the lock stitch belt wheel 142 and the lock stitch connecting ring 141, and the connecting pawl 146 guided within the guide groove 142*b* of the lock stitch belt wheel 142 is pushed by the spring 149 so that the pawl portion 146*a* is engaged with the engaging groove 141*a* of the lock stitch connecting ring 141. Therefore, when the driving shaft 116 is driven, the lock stitch mechanism is driven via the lock stitch connecting mechanism 141, the connecting pawl 146 and the lock stitch belt wheel 142. In this condition, since the other end portion 153*b* of the lock stitch switching arm 153 pushes the actuating piece 157 of the microswitch, the lock stitch lamp lights and the overlock stitch lamp 78 is turned off. The indicator 113 indicates the lock stitch indication 162*c* of the switch gear 162.

For switching the lock stitching to the overlock stitching when the flywheel 112 is manually rotated to allow the indication line 112*a* to meet the lock stitch mark 111 while the sewing machine is stopped, the engaging groove 142*c* of the lock stitch belt wheel 142 and the engaging groove 146*a* of the connecting pawl 146 have access to a phase engageable with the engaging pawl portion 153*a* of the lock stitch switching arm 153, and the switching hole 112*d* of the flywheel 112 coincides with the pin 171 of the flywheel gear 169 and the hole 185*a* of the belt wheel body 185 coincides with a stopper pin 166. Therefore the flywheel may be inserted in the direction shown by arrow H. At other phases the stopper pin 166 pressed by the face 112*e* of the flywheel 112 is hindered by the face 185*b* of the belt wheel 122 so that the flywheel cannot be inserted.

When the flywheel 112 is pushed in the direction of the arrow H against the spring 175 at the phase where the indication line 112*a* meets the lock stitch mark 111, the stopper pin 166 is pushed by the face 112*e* of the flywheel 112 and goes into the hole 185*a* of the belt wheel body 185 to lock the rotation of the drive shaft 116, so that the lock stitch mechanism engaging the drive shaft 116 and the overlock stitch mechanism engaging the engaging pawl portion 154*a* of the overlock stitch switching arm 154 are not rotated by an external force. Then the pin 171 of the flywheel gear 169 goes into the switching hole 112*d* of the flywheel 112, and the drive pins 112*b* and 112*c* of the flywheel 112 come out from the driving grooves 172*a* and 172*b* of the phase plate 172 so that the flywheel 112 is ready for rotation with respect to the drive shaft 116.

When the flywheel 112 is rotated toward the overlock stitch mark 110, the flywheel gear 169 is rotated in the clockwise direction via the pin 171, and the switching gear 162 is rotated together with the switch shaft 150 in the counterclockwise direction. In this case, even if an attempt is made to try and rotate the flywheel 112 in opposition to the overlock stitch mark 110, it cannot be rotated in this direction since the overlock stitch switching arm 154 serves as a stopper.

When the switching shaft 150 is rotated in the counterclockwise direction, the overlock stitch switching arm 154 exceeds upwardly at its hole 154*b* the segment J in FIG. 24, and the engaging pawl portion 154*a* separates from the engaging groove 130*c* of the overlock stitch belt wheel 130 and the engaging groove 136*b* of the connecting pawl 136 due to the biasing force of the switching spring 160, and the connecting pawl 136 is biased by the spring 139, and the pawl portion 136*a* engages the engaging groove 135*a* of the overlock stitch connecting ring 135.

At the same time, the lock stitch switching arm 153 pushes out with its engaging pawl portion 153*a* the pawl portion 146*a* of the connecting pawl 146 from the engaging groove 141*a* of the lock stitch connecting ring 141 by the biasing force of the switching spring 160 against the spring 149, and breaks the connection between the driving shaft 116 and the lock stitch belt wheel 142, and engages the engaging groove 146*b* of the connecting pawl 146 and the engaging groove 142*c* of the lock stitch belt wheel 142, and is stopped from rotating by the external force for the lock stitch mechanism. The lock stitching arm 153 separates at its other end 153*b* from the actuating piece 157, and the lock stitch lamp turns off and the lock stitch lamp lights. The switching gear 162 is rotated via the flywheel gear 169 and the indicator 113 indicates the indication 162*d* of the overlock stitch.

When the hand is released from the flywheel 112, it is pushed out in the direction opposite to that of arrow H in FIG. 23, and the driving pins 112*b* and 112*c* engage the driving grooves 172*c* and 172*d* of the phase plate 172. If the driving shaft 116 is driven under this condition, the overlock stitch mechanism is driven via the overlock stitch connecting ring 135, the connecting pawl 136 and the overlock stitch belt 130.

For switching the overlock stitching to the lock stitching when the flywheel is manually rotated to allow the indication line 112*a* to meet the overlock stitch mark 110 while the sewing machine is stopped, the engaging groove 130*c* of the overlock stitch belt 130 and the engaging groove 136*b* of the switching pawl 136 have an access to a phase engageable with the engaging pawl portion 154*a*, and the switching pawl 112*d* of the flywheel 112 coincides with the pin 171 of the flywheel gear 169, and the hole 185*a* of the belt wheel body 185*a* coincides with the stopper 166. When flywheel 112 is pushed in the direction of the arrow H in FIG. 23 against the spring 175, stopper pin 166 goes into the hole 185*a* of the belt wheel body 185 and locks the rotation of the driving shaft 116. At the same time, the pin 171 of the flywheel gear 169 engages the switching hole 112*d* of the flywheel 112. Since the driving pins 112*b* and 112*c* come out from the driving grooves 172*c* and 172*d* of the phase plate 172 and if the flywheel 112 is rotated toward the lock stitching mark 111, the switching gear 162 is, reversely to the switching, rotated together with the switching shaft 150 in the clockwise direction, and since the hole 154*b* of the overlock switching arm 154 exceeds downwardly the segment J in FIG. 24, the engaging pawl 154*a* pushes out the pawl portion 136*a* of the connecting pawl 136 from the engaging groove 135*a* of the overlock connecting ring 135 by means of the switching spring 160, and breaks the connection between the driving shaft 116 and the overlock stitch belt wheel 130, and engages the engaging groove 136*b* of the connecting pawl 136 and the engaging groove 130*c* of the overlock stitch belt wheel 130, and is stopped from rotating by external force for the overlock stitching mechanism. The engaging pawl portion 153*a* of the lock stitch switching arm 153 is separated from the engaging groove 142*c* of the belt wheel 142 and the engaging groove 146*b* of the connecting pawl 146, and the pawl portion 146*a* engages the engaging groove 141*a* of the lock stitch connecting ring 141. The other end portion of the lock stitch switching arm 153 pushes the actuating piece 157 of the microswitch. The lock stitch lamp lights and the overlock stitch lamp 78 is turned off. The switching gear 162 is rotated via the flywheel gear 169, and the indicator 162*c* of the lock stitch indicates the lock stitching on the indicating window 113.

When the hand is released from the flywheel 112, it is pushed out in the direction opposite to that of arrow H in FIG. 23, and the driving pins 112*b* and 112*c* engage the driving grooves 172*a* and 172*b* of the phase plate 172 for selecting the lock stitching.

The stitching mechanism is not only driven by the drive source but also worked by the manual operation of the flywheel 112 in the forward or backward direction, since the belt wheel bush 114 is fixed to the driving shaft 116 by the screw 115. Therefore adjustment by the manual operation of the flywheel 112 is provided for.

The thread coiling operation will now be explained. A lower thread bobbin (not shown) is set on the thread coiling rod 11. When the thread coiling arm 178 is rotated about the step screw 180 in the counterclockwise direction in FIG. 22, the arm 178 is moved in the same direction, accompanying the thread coiling rubber, by the biasing force of the spring 181 so that the rubber 179 is pressed to the knurl 122*b* of the belt wheel 122. Under this condition, the projection 178*b* is separated from the engaging face 182*a*, and the declutch arm 182 is rotated in the clockwise direction in FIG. 22 about the step screw 183 by means of the spring 184, and the lower end portion 182*b* enters the moving locus of the projection 121*b* of the clutch lever 121. When the motor is rotated and since the lower end portion 182*b* engages the projection 121*b* and the clutch lever 121 releases the roller 188, the belt wheel 122 is idle in rotation with respect to the belt wheel bush 114, and the thread coiling rod 11 is rotated by the knurl 122*b* via the coiling rubber 179, and the coiling is carried out. During this period the flywheel 112 driving the belt wheel bush 114 and the selected stitching mechanism are at rest.

When the thread coiling arm 178 is released from the coiling condition, the rubber 179 separates from the knurl 122*b* of the belt wheel 122 so that no rotation is transmitted to the thread coiling rod 11, while the projection 178*b* of the coiling arm 178 rotates the declutch arm 182 about the step screw 183 in the counterclockwise direction in FIG. 22, and since the lower end portion 182*b* of the declutch arm 182 is outside of the moving locus of the projection 121*b* of the clutch lever 121, the clutch lever 121 returns the roller 188 to the initial position. Therefore, the roller 188 transmits the driving force to the belt bush 114 from the belt wheel 122, and the selected mechanism is driven with the flywheel.

The looper mechanism will now be referred to. As shown in FIG. 2 the stitching portion 3 of the overlock stitching mechanism is provided at the left side of the machine frame 13 as seen from the machine operator and at the front side with respect to the lock stitch free arm 15, and the space T (FIG. 5) is defined between the rear end 19*a* of the needle plate 19 and the front face 15*b* of the free arm 15, through which the cloth passes. For feeding the sewn cloth through the space T and between the lower part of the free arm 15 and the upper face of the base 16, the space should be 7 to 8 mm at least. If the surface of the needle plate 19 becomes near in height to the needle plate surface 15*a* or higher, the size would be required to be more than 7 to 8 mm. Therefore, it is preferable that the needle plate 19 be lower than the needle plate surface 15*a* as possible in view of making the whole body of the sewing machine compact.

Figure 27:
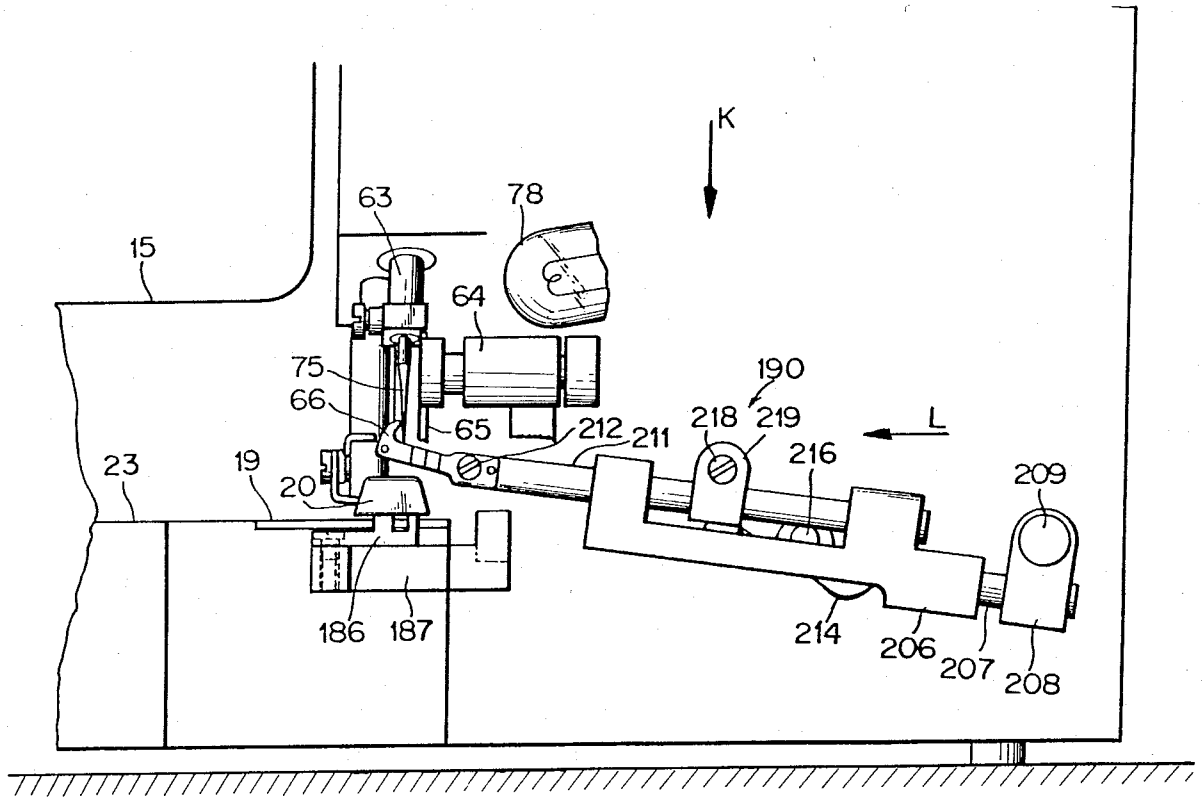
FIG. 27 is a view showing a stitching portion of the overlock stitching mechanism seen from the arrow E of FIG. 13 and a main part of a looper mechanism.

If the surface of the needle plate 19 were positioned as low as possible with respect to the surface 15*a*, the relative mechanisms incorporated under the surface 19 would be limited in vertical size. In the present embodiment, there are arranged, under the needle plate 19, the feed dog 186, the feed bed 187 and parts of the looper mechanism 190 driving the looper 66 as shown in FIG. 27. Only the looper mechanism 190 possess a problem in height, whereas the former two are small in size.

Further in this embodiment, a main shaft 191 of the over lock mechanism supports its one end at the inside of the free arm 15 and the other end at the side of the flywheel 112 of the machine frame, whereby the main shaft is disposed at a higher level than in the conventional sewing machine so that these arranging conditions could be satisfied.

In addition, the looper to be driven by the looper mechanism 190 draws different loci in the moving out and in travels, thereby preventing the interruption which has been inevitable in this kind of sewing machine, that is, the interruption of the end portion of the looper and the needle 75 when the looper moves to the leftmost end under the needle plate.

Figure 28:
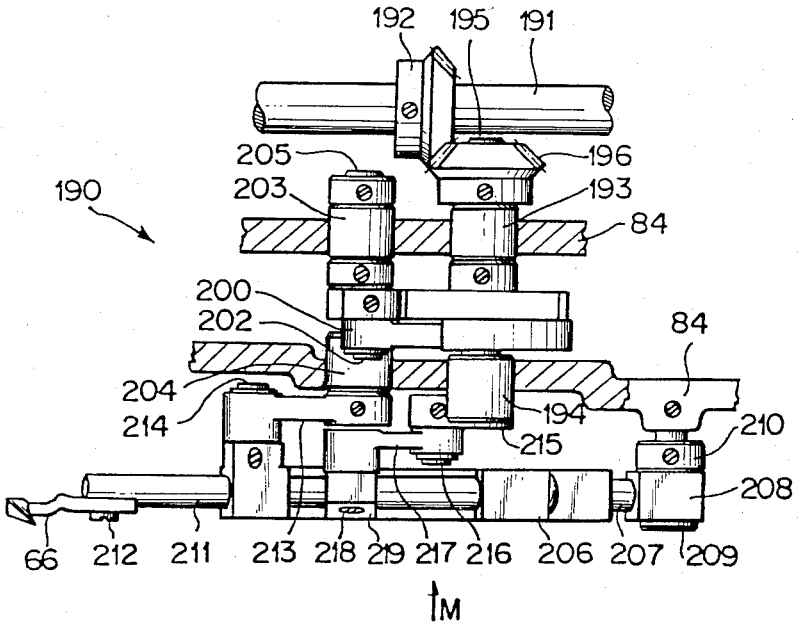
FIG. 28 is a view showing a main part of the looper mechanism seen from an arrow K of FIG. 27.
Figure 29:
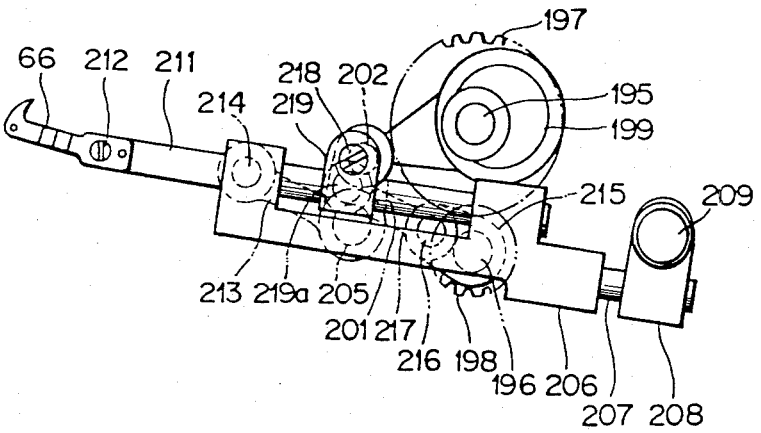
FIG. 29 is a view showing the main part of the looper mechanism seen from an arrow M of FIG. 28.
Figure 30:
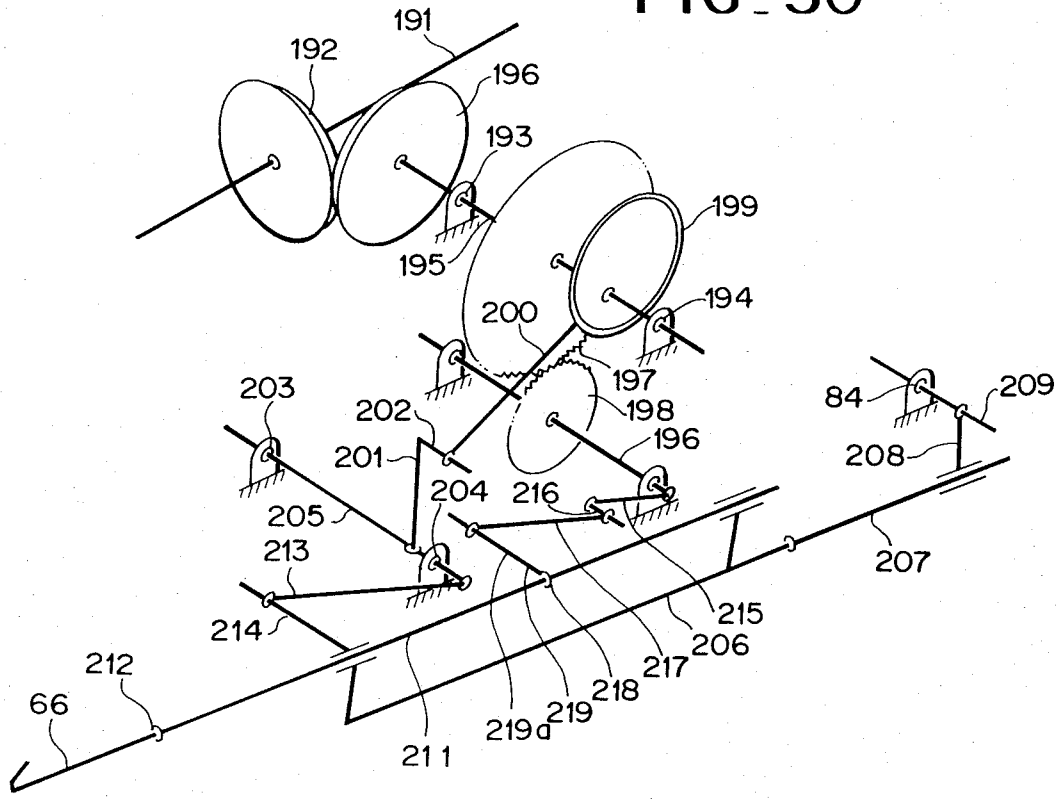
FIG. 30 is a schematic view of the looper mechanism.
Figure 31:
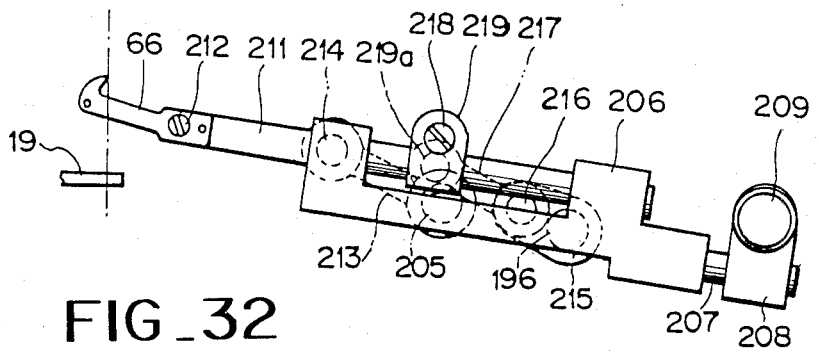
FIGS. 31 to 34 are views showing a main shaft of the overlock stitching of the looper mechanism at different rotational angles wherein FIG. 32 the rotational angle is 90°, in FIG. 33 the rotational angle is 180° and in FIG. 34 that angle is 270°.
Figure 32:
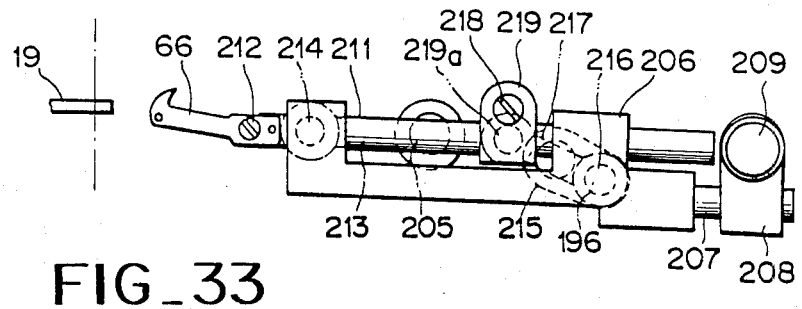
Figure 33:
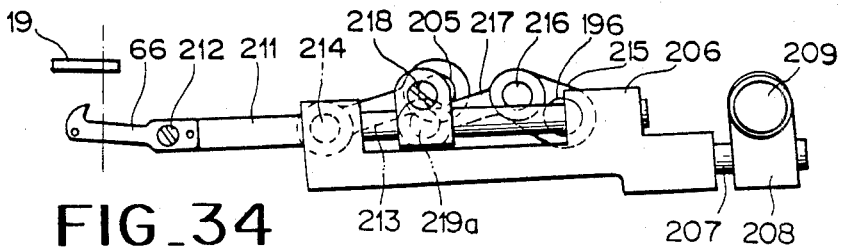
Figure 34:
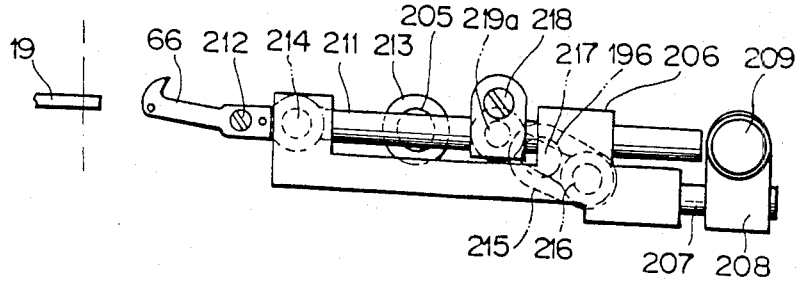

Referring to FIGS. 28 to 30, although not showing, the main shaft 191 of the overlock stitching is supported at its one end inside of the free arm 15 and at its other end extends to the side of the flywheel 112, and is screwed with a bevel gear 192. A looper shaft 195 crosses the main shaft 191, and is rotatably held to the machine frame 84 via the bearing tubes 193 and 194, and is screwed with a bevel gear 196. The bevel gear 196 gears a bevel gear 192, and the looper shaft 195 rotates with a ratio of 1:1 with respect to the main shaft 191. The looper shaft 195 and the looper shaft 196 are fixed with flat gears 197 and 198, and by their gearings the rotation is transmitted from the looper shaft 195 to the looper shaft 196, and if the looper shaft makes one rotation, the looper shaft 196 makes two rotations.

The looper shaft 195 is fixed with an eccentric cam 199 which holds one end of a rod 200, and the other end of the rod holds a pin 202 secured to a turning arm 201 which is secured to a looper shaft 205 rotatably pivoted to the machine frame 84 via the bearing tubes 203 and 204, and when the eccentric cam 199 is rotated the looper shaft 205 is turned. The looper supporter 206 is screwed with a support shaft 207 which is slidably mounted on the supporter 208.

The supporter 208 is thrust-stopped by a pin 209 and a thrust stopper 201, and the pin 209 is screwed into the machine frame 84. Therefore, the supporter 208 is rotatable about the pin 209.

A looper holding shaft 211 is slidably supported to the looper supporter 206 in the lengthwise direction and at its end part the looper 66 is secured with a screw 212. The looper shaft 205 is, at its end point, screwed with one end of a turning arm 213 for vertically moving the looper. The turning arm 213 is, at its other end, movably mounted with a pin 214 secured to the looper supporter 206 so that the movement of the turning arm 201 is transmitted to the looper supporter 206. A looper shaft 196 is, at its end, secured with a looper crank arm. A pin 216 secured to the other end of the looper crank arm 215 is rotatably supported with one end of a looper link 217, and the other end of the looper link 217 is rotatably supported to a shaft 219*a* projecting from a looper holding bar holder 219 which is secured to a screw 218. Therefore, for one rotation of the main shaft 191, the looper supporter 206 turns one reciprocation about the pin 209, and the looper holding shaft 211 slides two reciprocations for the looper supporter 206. By their composite movement, the looper 66 is driven, and for the rotational angles 0°, 90°, 180° and 270° of the overlock stitching main shaft 191, the looper mechanism 190 is driven as shown in FIGS. 31, 32, 33 and 34, and the looper draws the locus at its end as shown in FIG. 35.

Figure 35:
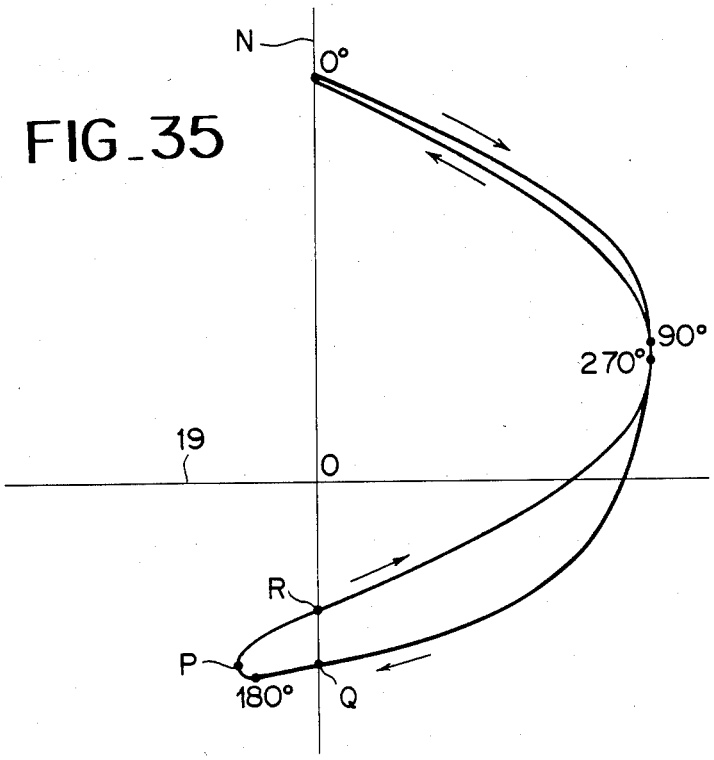
FIG. 35 is a diagram showing a moving locus of the looper.
Figure 36:
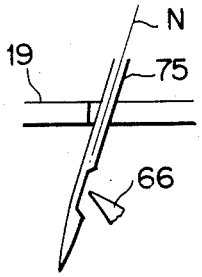
Figure 37:
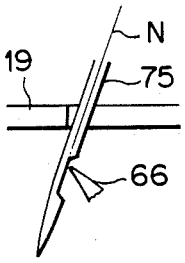

According to the looper mechanism 190 of the invention, the looper 66 draws the locus which is defined by a different curve in the going and coming travel directions as shown in FIG. 35. A point Q, at which the end point of the looper 66 passes toward the leftmost point P under the needle plate along the needle dropping line N seen from an arrow M of FIG. 28, passes a deeper position seen from the surface of the needle plate 19 than a starting point R of catching the needle thread. The needle 75 is right angled in its moving locus with the needle plate 19 in the direction of arrow M in FIG. 28, but in the direction of arrow L in FIG. 27 it is oblique with respect to the surface of the needle plate 19 as shown in FIGS. 36 and 37, and therefore the end point of the looper 66 passes at the point Q in FIG. 35 without interruption with the needle as shown in FIG. 36., and at the point R it passes as it catches the thread loop (not shown) of the overlock stitching thread with respect to the needle 75 as in FIG. 37.

Figure 38:
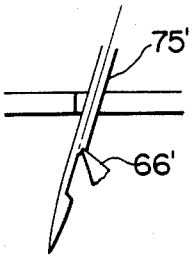
FIGS. 38 and 39 are views showing relative positions between the end point of the looper and the needle in the prior art, in which FIG. 38 corresponds to FIG. 36 and FIG. 39 corresponds to FIG. 37.
Figure 39:
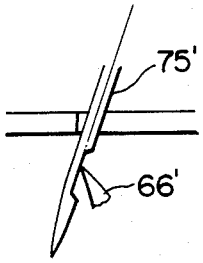
Prior art FIG 39

In the prior art, the points corresponding to the points Q and R in the present embodiment meet each other, and if a looper 66' catches the loop at a point corresponding to the point R, the end point of the looper 66' and the needle 75' interrupt each other at a point corresponding to the point Q as shown in FIG. 38. In the present embodiment, such a problem has been solved.

As mentioned above, in accordance with the looper mechanism 190 of the invention, the main shaft of the overlock stitch mechanism is supported with its one end which is held inside of the free arm 15 and with its other end which is held at the flywheel 112 of the machine frame 84. In such a manner, the looper mechanism 190 is disposed at a level higher than that in the foregoing sewing machine, whereby the stitching portion 3 of the overlock stitch mechanism is disposed such that the surface of the needle plate 19 is positioned under the needle plate surface 15*a* of the lock stitching. In addition to the observation of passing the stitched fabric 14 and for observing the stitched fabric after having been stitched, the space T is prepared with the minimum size, so that the whole body of the sewing machine may be structed in a compact size.

Since the looper 66 driven by the looper mechanism 190 draws the locus of the closed loops which are different in the going and coming travels, it is possible to prevent interruption of the needle 75 and the end point of the looper 66 moving toward the leftmost point P under the needle plate, this interruption having been inevitable in the prior art.

It will be understood that each of the elements described above, or two or more together, may also find a useful application in other types of constructions differing from the types described above.

While the invention has been illustrated and described as embodied in a double-function sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A double functioning sewing machine, comprising:

a base having an upper side and a rear end portion and being partly formed with a hollow frame having a top and a rear side;

a machine frame having a top, a one side, a bracket, an arm, and a front side formed with a recess, said machine frame being formed so as to rise from said rear end portion of said base to said top from which said arm laterally extends and overhangs said base and terminates into said bracket;

a lock stitch mechanism provided in said machine frame and including an operatively connected lock stitching needle bar with a needle, said lock stitching needle bar with said needle being supported by said bracket of said arm of said machine frame;

a free arm having a bottom face and a front side and disposed rearwardly on said one side of said machine frame and extending between said arm and said base;

an overlock stitch mechanism provided in said machine frame and including an overlock stitching needle bar with a needle, a presser bar with a presser foot, all being disposed in said recess of said front side of said machine frame adjacent said one side where said free arm is provided;

a loop taker driver provided in said free arm;

a loop taker provided in said free arm and driven by said loop taker driver to cooperate with said lock stitching needle bar with said needle supported by said bracket so as to produce lock stitches;

a fabric feed device disposed in said hollow frame of said base;

a looper mechanism disposed in said hollow frame of said base, said looper mechanism and said fabric feed device cooperating with said overlock stitching needle to produce overlock stitches; and an overlock stitch working surface disposed at said top of said hollow frame and being at a level slightly lower than said bottom face of said free arm and slightly extending from said one side of said machine frame and being parallel with said free arm so that a path is defined by said rear side of said hollow frame, said front side of said free arm, said upper side of said base, and said bottom face of said free arm for guiding a fabric towards said rear end portion of said base as the fabric is transported by said fabric feed device during overlock stitching operation.

2. The sewing machine as defined in claim 1, wherein said machine frame has a rear side on which is mounted a thread guide unit being turnably expanded away from said machine frame when in use and being turnably contracted towards said machine frame when not in use.

3. The sewing machine as defined in claim 2, wherein said thread guide unit includes a support and a thread guide bar axially supported by said support, said thread guide bar being axially adjustable with respect to said support.

4. The sewing machine as defined in claim 2; further comprising thread stands for lock stitch stitching and overlock stitching, said thread stands being arranged on said base and selectively used to supply thread to said overlock stitching needle through said thread guide bar and to said lock stitching needle through another part of said thread guide unit.

5. A double-function sewing machine, comprising a frame; a base; a lock stitching free arm extended above said base and in spaced relation therewith and extended leftwardly of said frame as seen from the machine operator, said free arm having a front side facing the machine operator, a lock stitching mechanism having a lock stitching portion positioned on said free arm and having a lock stitch needle plate; an overlock stitch mechanism having an overlock stitching portion provided with an overlock stitch needle plate having a rear end facing towards said lock stitching portion, said overlock stitching portion being positioned at the left side of said frame as seen from the machine operator and being spaced from said free arm towards the machine operator such that a predetermined space is defined between the rear end of the overlock stitch needle plate and the front side of said free arm, a fabric, on which overlock stitches are produced, passing through said space; a safety cover covering the overlock stitching mechanism and a space in the vicinity of said overlock stitching portion; and a transparent auxiliary safety cover secured to the first mentioned safety cover and extending therefrom towards the overlock needle plate to protect the overlock stitching portion and at the same time permit a satisfactory observation of the overlock stitching.

6. A double-function sewing machine, comprising a frame; a base; a lock stitching free arm extended above said base and in spaced relation therewith and extended leftwardly of said frame as seen from the machine operator, said free arm having a front side facing the machine operator, a lock stitching mechanism having a lock stitching portion positioned on said free arm and having a lock stitch needle plate in an overlock stitch mechanism having an overlock stitching portion provided with an overlock stitch needle plate having a rear end facing towards said lock stitching portion, said overlock stitching portion being positioned at the left side of said frame as seen from the machine operator and being spaced from said free arm towards the machine operator such that a predetermined space is defined between the rear end of the overlock stitch needle plate and the front side of said free arm, a fabric, on which overlock stitches are produced, passing through said space; and a dust exhaust plate below said overlock stitching portion and a front cover movable to shield said dust exhaust plate when the lock stitching mechanism is used or the sewing machine is at rest, or to expose said dust exhaust plate when the overlock stitching mechanism is used.

7. A double-function sewing machine, comprising a frame; a base; a lock stitching free arm extended above said base and in spaced relation therewith and extended leftwardly of said frame as seen from the machine operator, said free arm having a front side facing the machine operator, a lock stitching mechanism having a lock stitching portion positioned on said free arm and having a lock stitch needle plate; an overlock stitch mechanism having an overlock stitching portion provided with an overlock stitch needle plate having a rear end facing towards said lock stitching portion, said overlock stitching portion being positioned at the left side of side frame as seen from the machine operator and being spaced from said free arm towards the machine operator such that a predetermined space is defined between the rear end of the overlock stitch needle plate and the front side of said free arm, a fabric, on which overlock stitches are produced, passing through said space; a safety cover covering the overlock stitching mechanism and a space in the vicinity of said overlock stitching portion; and a transparent auxiliary safety cover secured to the first mentioned safety cover and extending therefrom towards the overlock needle plate to protect the overlock stitching portion and at the same time permit a satisfactory observation of the overlock stitching, said auxiliary safety cover having a lower end spaced from said overlock needle plate so that a predetermined space for feeding a fabric to be sewn to said overlock stitching portion is defined therebetween.

* * * * *